US011817303B2

(12) United States Patent
Verenchikov et al.

(10) Patent No.: US 11,817,303 B2
(45) Date of Patent: Nov. 14, 2023

(54) ACCELERATOR FOR MULTI-PASS MASS SPECTROMETERS

(71) Applicant: Micromass UK Limited, Wilmslow (GB)

(72) Inventors: Anatoly Verenchikov, Bar (ME); Mikhail Yavor, St. Petersburg (RU)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/636,877

(22) PCT Filed: Jul. 26, 2018

(86) PCT No.: PCT/GB2018/052105
§ 371 (c)(1),
(2) Date: Feb. 5, 2020

(87) PCT Pub. No.: WO2019/030477
PCT Pub. Date: Feb. 14, 2019

(65) Prior Publication Data

US 2020/0373145 A1 Nov. 26, 2020

(30) Foreign Application Priority Data

Aug. 6, 2017 (GB) ..... 1712612
Aug. 6, 2017 (GB) ..... 1712613
(Continued)

(51) Int. Cl.
*H01J 49/40* (2006.01)
*H01J 49/00* (2006.01)
(Continued)

(52) U.S. Cl.
CPC ..... *H01J 49/403* (2013.01); *H01J 49/0031* (2013.01); *H01J 49/025* (2013.01);
(Continued)

(58) Field of Classification Search
None
See application file for complete search history.

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101171660 A 4/2008
(Continued)

OTHER PUBLICATIONS

Hoyes et al., "Electrostatic gimbal for correction of errors in Time of Flight mass spectrometers", Waters, 2013 (Year: 2013).*
(Continued)

*Primary Examiner* — Michael J Logie
(74) *Attorney, Agent, or Firm* — Goodwin Procter LLP

(57) ABSTRACT

Improved pulsed ion sources and pulsed converters are proposed for multi-pass time-of-flight mass spectrometer, either multi-reflecting (MR) or multi-turn (MT) TOF. A wedge electrostatic field (45) is arranged within a region of small ion energy for electronically controlled tilting of ion packets (54) time front. Tilt angle γ of time front (54) is strongly amplified by a post-acceleration in a flat field (48). Electrostatic deflector (30) downstream of the post-acceleration (48) allows denser folding of ion trajectories, whereas the injection mechanism allows for electronically adjustable mutual compensation of the time front tilt angle, i.e. γ=0 for ion packet in location (55), for curvature of ion packets, and for the angular energy dispersion. The arrangement helps bypassing accelerator (40) rims, adjusting ion
(Continued)

packets inclination angles $\alpha_2$ and what is most important, compensating for mechanical misalignments of the optical components.

20 Claims, 12 Drawing Sheets

(30) Foreign Application Priority Data

| | | |
|---|---|---|
| Aug. 6, 2017 | (GB) | 1712614 |
| Aug. 6, 2017 | (GB) | 1712616 |
| Aug. 6, 2017 | (GB) | 1712617 |
| Aug. 6, 2017 | (GB) | 1712618 |
| Aug. 6, 2017 | (GB) | 1712619 |

(51) Int. Cl.
*H01J 49/02* (2006.01)
*H01J 49/06* (2006.01)
*H01J 49/16* (2006.01)
*H01J 49/42* (2006.01)

(52) U.S. Cl.
CPC ..... *H01J 49/061* (2013.01); *H01J 49/164* (2013.01); *H01J 49/401* (2013.01); *H01J 49/405* (2013.01); *H01J 49/406* (2013.01); *H01J 49/4245* (2013.01)

(56) References Cited

U.S. PATENT DOCUMENTS 4,691,160 A 9/1987 Ino
4,731,532 A 3/1988 Frey et al.
4,855,595 A 8/1989 Blanchard
4,970,390 A 11/1990 Szymczak
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,652,427 A 7/1997 Whitehouse et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,847,385 A * 12/1998 Dresch ..... H01J 49/025 250/287
5,869,829 A 2/1999 Dresch
5,896,829 A 4/1999 Rothenberg et al.
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov

(56) References Cited

U.S. PATENT DOCUMENTS 7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1* 8/2001 Franzen ..... H01J 49/401 250/287
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0026613 A1 2/2004 Bateman et al.
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0024720 A1 2/2006 McLean et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0121796 A1 5/2008 Green et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0121130 A1 5/2009 Satoh
2009/0206250 A1 8/2009 Wollnik
2009/0250607 A1 10/2009 Staats et al.
2009/0272890 A1 11/2009 Ogawa et al.
2009/0294658 A1* 12/2009 Vestal ..... H01J 49/40 250/287
2009/0314934 A1 12/2009 Brown
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0096543 A1 4/2010 Kenny et al.
2010/0108878 A1 5/2010 Bateman et al.
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2012/0298853 A1 11/2012 Kurulugama et al.
2013/0048852 A1 2/2013 Verenchikov
2013/0056627 A1 3/2013 Verenchikov
2013/0068942 A1 3/2013 Verenchikov

(56) References Cited

U.S. PATENT DOCUMENTS

| | | | | |
|---|---|---|---|---|
| 2013/0161506 | A1 | 6/2013 | Ugarov | |
| 2013/0187044 | A1 | 7/2013 | Ding et al. | |
| 2013/0206978 | A1* | 8/2013 | Verenchikov | H01J 49/0031 250/282 |
| 2013/0240725 | A1 | 9/2013 | Makarov | |
| 2013/0248702 | A1 | 9/2013 | Makarov | |
| 2013/0256524 | A1* | 10/2013 | Brown | H01J 49/067 250/282 |
| 2013/0313424 | A1 | 11/2013 | Makarov et al. | |
| 2013/0327935 | A1 | 12/2013 | Wiedenbeck | |
| 2014/0054454 | A1 | 2/2014 | Hoyes et al. | |
| 2014/0054456 | A1 | 2/2014 | Kinugawa et al. | |
| 2014/0084156 | A1 | 3/2014 | Ristroph et al. | |
| 2014/0117226 | A1 | 5/2014 | Giannakopulos | |
| 2014/0138538 | A1 | 5/2014 | Hieftje et al. | |
| 2014/0183354 | A1 | 7/2014 | Moon et al. | |
| 2014/0191123 | A1 | 7/2014 | Wildgoose et al. | |
| 2014/0239172 | A1 | 8/2014 | Makarov | |
| 2014/0246575 | A1* | 9/2014 | Langridge | H01J 49/0009 250/282 |
| 2014/0291503 | A1 | 10/2014 | Shchepunov et al. | |
| 2014/0312221 | A1 | 10/2014 | Verenchikov et al. | |
| 2014/0361162 | A1 | 12/2014 | Murray et al. | |
| 2015/0028197 | A1 | 1/2015 | Grinfeld et al. | |
| 2015/0028198 | A1 | 1/2015 | Grinfeld et al. | |
| 2015/0034814 | A1 | 2/2015 | Brown et al. | |
| 2015/0048245 | A1 | 2/2015 | Vestal et al. | |
| 2015/0060656 | A1 | 3/2015 | Ugarov | |
| 2015/0122986 | A1 | 5/2015 | Haase | |
| 2015/0144779 | A1 | 5/2015 | Verenchikov | |
| 2015/0194296 | A1 | 7/2015 | Verenchikov et al. | |
| 2015/0228467 | A1 | 8/2015 | Grinfeld et al. | |
| 2015/0270115 | A1 | 9/2015 | Furuhashi | |
| 2015/0279650 | A1 | 10/2015 | Verenchikov | |
| 2015/0294849 | A1 | 10/2015 | Makarov et al. | |
| 2015/0318156 | A1 | 11/2015 | Loyd et al. | |
| 2015/0364309 | A1 | 12/2015 | Welkie | |
| 2015/0380206 | A1 | 12/2015 | White et al. | |
| 2015/0380233 | A1 | 12/2015 | Verenchikov | |
| 2016/0005587 | A1 | 1/2016 | Verenchikov | |
| 2016/0035558 | A1 | 2/2016 | Verenchikov et al. | |
| 2016/0079052 | A1 | 3/2016 | Makarov | |
| 2016/0225598 | A1 | 8/2016 | Ristroph | |
| 2016/0225602 | A1 | 8/2016 | Ristroph et al. | |
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0084443 | A1 | 3/2017 | Willis et al. | |
| 2017/0098533 | A1 | 4/2017 | Stewart et al. | |
| 2017/0168031 | A1 | 6/2017 | Verenchikov | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0330936 | A1 | 11/2018 | Hoyes et al. | |
| 2018/0366312 | A1 | 12/2018 | Hamish et al. | |
| 2018/0366313 | A1 | 12/2018 | Hoyes et al. | |
| 2019/0019664 | A1* | 1/2019 | Furuhashi | H01J 49/401 |
| 2019/0180998 | A1 | 6/2019 | Stewart et al. | |
| 2019/0206669 | A1 | 7/2019 | Verenchikov et al. | |
| 2019/0237318 | A1 | 8/2019 | Brown | |
| 2019/0360981 | A1 | 11/2019 | Verenchikov | |
| 2020/0083034 | A1 | 3/2020 | Hoyes et al. | |
| 2020/0090919 | A1 | 3/2020 | Artaev et al. | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov et al. | |
| 2020/0243322 | A1 | 7/2020 | Stewart et al. | |
| 2020/0373142 | A1 | 11/2020 | Verenchikov | |
| 2020/0373143 | A1 | 11/2020 | Verenchikov et al. | |
| 2020/0373145 | A1 | 11/2020 | Verenchikov et al. | |

FOREIGN PATENT DOCUMENTS

| | | | | |
|---|---|---|---|---|
| CN | 101369510 | A | 2/2009 | |
| CN | 101523548 | A | 9/2009 | |
| CN | 102131563 | A | 7/2011 | |
| CN | 201946564 | U | 8/2011 | |
| CN | 102884608 | A | 1/2013 | |
| CN | 103270574 | A | 8/2013 | |
| CN | 104067116 | A | 9/2014 | |
| CN | 104508475 | A | 4/2015 | |
| CN | 105206500 | A | 12/2015 | |
| CN | 106463337 | A | 2/2017 | |
| CN | 107636795 | A | 1/2018 | |
| CN | 107833823 | A | 3/2018 | |
| CN | 107851549 | A | 3/2018 | |
| CN | 108292587 | A | 7/2018 | |
| DE | 4310106 | C1 | 10/1994 | |
| DE | 10116536 | A1 | 10/2002 | |
| DE | 102015121830 | A1 | 6/2017 | |
| DE | 102019129108 | A1 | 6/2020 | |
| DE | 112015001542 | B4 | 7/2020 | |
| EP | 0237259 | A2 | 9/1987 | |
| EP | 1137044 | A2 | 9/2001 | |
| EP | 1566828 | A2 | 8/2005 | |
| EP | 1901332 | A1 | 3/2008 | |
| EP | 2068346 | A2 | 6/2009 | |
| EP | 1665326 | B1 | 4/2010 | |
| EP | 1789987 | A4 | 9/2010 | |
| EP | 1522087 | B1 | 3/2011 | |
| EP | 2599104 | A1 | 6/2013 | |
| EP | 1743354 | B1 | 8/2019 | |
| EP | 3662501 | A1 | 6/2020 | |
| EP | 3662502 | A1 | 6/2020 | |
| EP | 3662503 | A1 | 6/2020 | |
| GB | 2080021 | A | 1/1982 | |
| GB | 2217907 | A | 11/1989 | |
| GB | 2274197 | A * | 7/1994 | H01J 49/401 |
| GB | 2300296 | A | 10/1996 | |
| GB | 2390935 | A | 1/2004 | |
| GB | 2396742 | A | 6/2004 | |
| GB | 2403063 | A | 12/2004 | |
| GB | 2455977 | A | 7/2009 | |
| GB | 2476964 | A | 7/2011 | |
| GB | 2478300 | A | 9/2011 | |
| GB | 2484361 | B | 4/2012 | |
| GB | 2484429 | B | 4/2012 | |
| GB | 2485825 | A | 5/2012 | |
| GB | 2489094 | A | 9/2012 | |
| GB | 2490571 | A | 11/2012 | |
| GB | 2495127 | A | 4/2013 | |
| GB | 2495221 | A | 4/2013 | |
| GB | 2496991 | A | 5/2013 | |
| GB | 2496994 | A | 5/2013 | |
| GB | 2500743 | A | 10/2013 | |
| GB | 2501332 | A | 10/2013 | |
| GB | 2506362 | A | 4/2014 | |
| GB | 2528875 | A | 2/2016 | |
| GB | 2555609 | A | 5/2018 | |
| GB | 2556451 | A | 5/2018 | |
| GB | 2556830 | A | 6/2018 | |
| GB | 2562990 | A | 12/2018 | |
| GB | 2575157 | A | 1/2020 | |
| GB | 2575339 | A | 1/2020 | |
| GB | 2595530 | A | 12/2021 | |
| GB | 2610692 | A | 3/2023 | |
| JP | S6229049 | A | 2/1987 | |
| JP | 2000036285 | A | 2/2000 | |
| JP | 2000048764 | A | 2/2000 | |
| JP | 2001297730 | A | 10/2001 | |
| JP | 2003031178 | A | 1/2003 | |
| JP | 2003502803 | A | 1/2003 | |
| JP | 3571546 | B2 | 9/2004 | |
| JP | 2005538346 | A | 12/2005 | |
| JP | 2006049273 | A | 2/2006 | |
| JP | 2007227042 | A | 9/2007 | |
| JP | 2010062152 | A | 3/2010 | |
| JP | 4649234 | B2 | 3/2011 | |
| JP | 2011119279 | A | 6/2011 | |
| JP | 4806214 | B2 | 11/2011 | |

(56) References Cited

FOREIGN PATENT DOCUMENTS

| | | | |
|---|---|---|---|
| JP | 2013528892 | A | 7/2013 |
| JP | 2013539590 | A | 10/2013 |
| JP | 5555582 | B2 | 7/2014 |
| JP | 2015506567 | A | 3/2015 |
| JP | 2015521349 | A | 7/2015 |
| JP | 2015185306 | A | 10/2015 |
| RU | 2564443 | C2 | 10/2015 |
| RU | 2015148627 | A | 5/2017 |
| RU | 2660655 | C2 | 7/2018 |
| SU | 198034 | A1 | 6/1967 |
| SU | 1681340 | A1 | 9/1991 |
| SU | 1725289 | A1 | 4/1992 |
| WO | 9103071 | A1 | 3/1991 |
| WO | 98001218 | A1 | 1/1998 |
| WO | 98008244 | A2 | 2/1998 |
| WO | 0077823 | A2 | 12/2000 |
| WO | 2005001878 | A2 | 1/2005 |
| WO | 2005043575 | A2 | 5/2005 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010034630 | A2 | 4/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 2013063587 | A2 | 5/2013 |
| WO | 2013067366 | A2 | 5/2013 |
| WO | 2013093587 | A1 | 6/2013 |
| WO | 2013098612 | A1 | 7/2013 |
| WO | 2013110587 | A2 | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 2014110697 | A1 | 7/2014 |
| WO | 2014142897 | A1 | 9/2014 |
| WO | 2014152902 | A2 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2015189544 | A1 | 12/2015 |
| WO | 2016064398 | A1 | 4/2016 |
| WO | 2016174462 | A1 | 11/2016 |
| WO | 2016178029 | A1 | 11/2016 |
| WO | 2017042665 | A1 | 3/2017 |
| WO | 2017087470 | A1 | 5/2017 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |
| WO | 2023285791 | A1 | 1/2023 |

OTHER PUBLICATIONS

International Search Report and Written Opinion for International Application No. PCT/US2016/062174 dated Mar. 3, 2017, 8 pages.
IPRP PCT/US2016/062174 issued May 22, 2018, 6 pages.
Search Report for GB Application No. GB1520130.4 dated May 25, 2016.
International Search Report and Written Opinion for International Application No. PCT/US2016/062203 dated Mar. 5, 2017, 8 pages.
Search Report for GB Application No. GB1520134.6 dated May 26, 2016.
IPRP PCT/US2016/062203, issued May 22, 2018, 6 pages.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
Search Report for GB Application No. 1520540.4 dated May 25, 2016.
IPRP for application PCT/US2016/063076, dated May 29, 2018, 7 pages.
IPRP PCT/GB17/51981 dated Jan. 8, 2019, 7 pages.
International Search Report and Written Opinion for International Application No. PCT/GB2018/051206, dated Jul. 12, 2018, 9 pages.
Author unknown, "Electrostatic lens," Wikipedia, Mar. 31, 2017 (Mar. 31, 2017), XP055518392, Retrieved from the Intemet URL https://en.wikipedia.org/w/index.phptitle=Electrostaticlens oldid=773161674[retrieved on Oct. 24, 2018].
Hussein, O.A. et al., "Study the most favorable shapes of electrostatic quadrupole doublet lenses", AIP Conference Proceedings, vol. 1815, Feb. 17, 2017 (Feb. 17, 2017), p. 110003.
Guan S., et al., "Stacked-ring electrostatic ion guide", Journal of the American Society for Mass Spectrometry, Elsevier Science Inc, 7(1):101-106 (1996).
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9, dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12. 2017, 5 pages.

(56) References Cited

OTHER PUBLICATIONS

Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/Posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov, A. N. "Parallel MS-MS Analysis in a Time-Flight Tandem. Problem Statement, Method, and Instrumental Schemes" Institute for Analytical Instrumentation RAS, Saint-Petersburg, (2004).
Yavor, M. I. "Planar Multireflection Time-Of-Flight Mass Analyzer with Unlimited Mass Range" Institute for Analytical nstrumentation RAS, Saint-Petersburg, (2004).
Khasin, Y. I. et al., "Initial Experimental Studies of a Planar Multireflection Time-Of-Flight Mass Spectrometer" Institute tor Analytical Instrumentation RAS, Saint-Petersburg, (2004).
Verenchicov, A. N. et al. "Stability of Ion Motion in Periodic Electrostatic Fields" Institute for Analytical Instrumentation RAS, Saint-Petersburg, (2004).
Verenchicov, A. N. "The Concept of Multireflecting Mass Spectrometer for Continuous Ion Sources" Institute for Analytical Instrumentation RAS, Saint-Petersburg, (2006).
Verenchicov, A. N., et al. "Accurate Mass Measurements for Interpreting Spectra of atmospheric Pressure Ionization" Institute for Analytical Instrumentation RAS, Saint-Petersburg, (2006).
Kozlov, B. N. et al., "Experimental Studies of Space Charge Effects in Multireflecting Time-Of-Flight Mass Spectrometes" Institute for Analytical Instrumentation RAS, Saint-Petersburg, (2006).
Kozlov, B. N. et al., "Multireflecting Time-Of-Flight Mass Spectrometer With an Ion Trap Source" Institute for Analytical nstrumentation RAS, Saint-Petersburg, (2006).
Hasin, Y. I., et al.,"Planar Time-Of-Flight Multireflecting Mass Spectrometer with an Orthogonal Ion Injection Out of Continuous Ion Sources" Institute for Analytical Instrumentation RAS, Saint-Petersburg, (2006).
Lutvinsky, Y. I., et al., "Estimation of Capacity of High Resolution Mass Spectra for Analysis of Complex Mixtures" Institute for Analytical Instrumentation RAS, Saint-Petersburg, (2006).
International Search Report and Written Opinion for International appliication No. PCT/GB2020/050209, dated Apr. 28, 2020, 12 pages.
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Oct. 16, 2019.
Wikipedia "Reflectron", Oct. 9, 2015, Retrieved from the Internet URL https://en.wikipedia.org/wlindex.php?title=Reflectron&oldid=684843442 [retrieved on May 29, 2019].
Toyoda, M. et al., "Multi-turn time-of-flight mass spectrometers with electrostatic sectors," Journal of Mass Spectrometry, 38:1125-1142(2003).
IPRP for International application No. PCT/GB2018/051206, dated Nov. 5, 2019, 7 pages.
International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Combined Search and Examination Report for United Kingdom Application No. GB1901411.7 dated Jul. 31, 2019.
Examination Report for United Kingdom Application No. GB1618980.5 dated Jul. 25, 2019.
Combined Search and Examination Report for GB 1906258.7, dated Oct. 25, 2019.
Combined Search and Examination Report for GB1906253.8, dated Oct. 30, 2019.
Search Report under Section 17(5) for GB1916445.8, dated Jun. 15, 2020.
Extended European Search Report for EP Patent Application No. 16866997.6 dated Oct. 16, 2019.
International Search Report and Written Opinion for International Application No. PCT/GB2019/051234 dated Jul. 29, 2019.
International Search Report and Written Opinion for International Application No. PCT/GB2019/051839 dated Sep. 18, 2019.
International Search Report and Written Opinion for International Application No. PCT/GB20180051320 dated Aug. 1, 2018.
Stresau, D., et al., "Ion Counting Beyond 10ghz Using a New Detector and Conventional Electronics", European Winter Conference on Plasma Spectrochemistry, Feb. 4-8, 2001, Lillehammer, Norway, Retrieved from the Internet URL https://www.etp-ms.com/file-repository/21 [retrieved on Jul. 31, 2019].
Kaufmann, R., et al., "Sequencing of peptides in a time-of-flight mass spectrometer: evaluation of postsource decay Following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
International Search Report and Written Opinion for International Application No. PCT/GB2018/051320 dated Aug. 1, 2018, 10 pages.
Shaulis, Barry, et al., "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
Sakurai, T, et al., "A new multi-passage time-of-flight mass spectrometer at JAIST", Nuclear Instruments and Methods in Physics Research A: Accelerators, Spectrometers, Detectors and Associated Equipment, 427(1-2):182-186 (1999).
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB 1906258.7, dated Dec. 11, 2020, 7 pages.
Carey, D.C., "Why a second-order magnetic optical achromat works", Nucl. Instrum. Meth., 189(203):365-367 (1981). Abstract.
Sakurai, T. et al., "Ion optics for time-of-flight mass spectrometers with multiple symmetry", Int J Mass Spectrom Ion Proc 63(2-3):273-287 (1985). Abstract.
Wollnik, H., and Casares, A., "An energy-isochronous multi-pass time-of-flight mass spectrometer consisting of two coaxial electrostatic mirrors", Int J Mass Spectrom 227:217-222 (2003). Abstract.
Author unknown, "Einzel Lens", Wikipedia [online] Nov. 2020 [retrieved on Nov. 3, 2020]. Retrieved from Intemet URL: https://en.wikipedia.org/wiki/Einzel_lens, 2 pages.
O'Halloran, G.J., et al., "Determination of Chemical Species Prevalent in a Plasma Jet", Bendix Corp Report ASD-TDR-62-644, U.S. Air Force (1964). Abstract.
Examination Report under Section 18(3) for Application No. GB1906258.7, dated May 5, 2021, 4 pages.
Collision Frequency, https://en.wikipedia.org/wiki/Collision_frequency accessed Aug. 17, 2021.

(56) References Cited

OTHER PUBLICATIONS

International Search Report and Written Opinion for International Application No. PCT/GB2020/050471, dated May 13, 2020, 9 pages.
Search Report for GB Application No. GB2002768.6 dated Jul. 7, 2020.
Search Report for GB Application No. GB 1903779.5, dated Sep. 20, 2019.
Verentchikov, A., et al., "Stable ion beam transport through periodic electrostatic structures: linear and non-linear effects", Physics Procedia, 1(1):87-97, Aug. 2008.
Willis, P. et al., "Improving duty cycle in the Folded Flight Path high-resolution time-of-flight mass spectrometer", International Journal of Mass Spectrometry, vol. 459, 116467, Nov. 1, 2020.

* cited by examiner

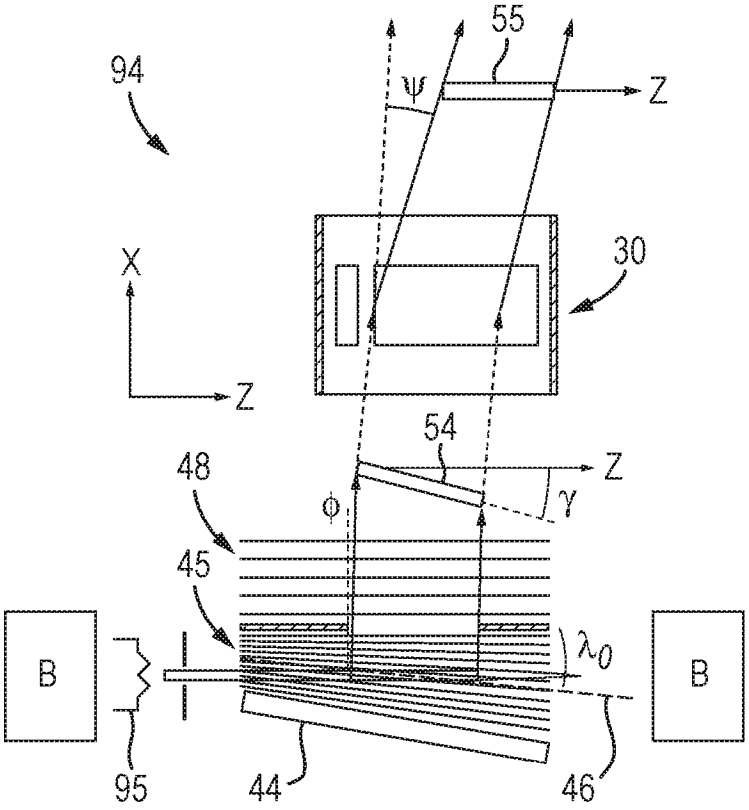
Fig. 9
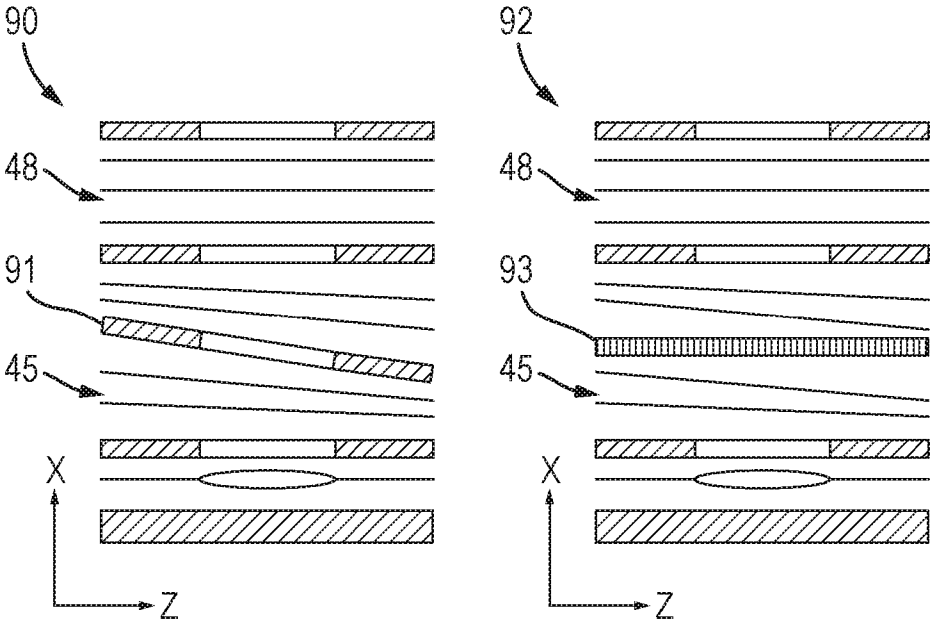

ACCELERATOR FOR MULTI-PASS MASS SPECTROMETERS

CROSS-REFERENCE TO RELATED APPLICATIONS

This application is a U.S. national phase filing under 35 U.S.C. § 371 claiming the benefit of and priority to International Patent Application No. PCT/GB2018/052105, filed on Jul. 26, 2018, which claims priority from and the benefit of United Kingdom patent application No. 1712612.9, United Kingdom patent application No. 1712613.7, United Kingdom patent application No. 1712614.5, United Kingdom patent application No. 1712616.0, United Kingdom patent application No. 1712617.8, United Kingdom patent application No. 1712618.6 and United Kingdom patent application No. 1712619.4, each of which was filed on Aug. 6, 2017. The entire content of these applications is incorporated herein by reference.

FIELD OF INVENTION

The invention relates to the area of time of flight mass spectrometers, multi-turn and multi-reflecting time-of-flight mass spectrometers with pulsed ion sources and pulsed converters, and is particularly concerned with improved ion injection.

BACKGROUND

Time-of-flight mass spectrometers (TOF MS) are widely used for combination of sensitivity and speed, and lately with the introduction of ion mirrors and multi-reflecting schemes, for their high resolution and mass accuracy. Pulsed sources are used for intrinsically pulsed ionization methods, such as Matrix Assisted Laser Desorption and Ionization (MALDI), Secondary Ionization (SIMS), and pulsed EI. The first two ion sources become more and more popular for mass spectral surface imaging, where a relatively large surface area is analyzed simultaneously while using mapping properties of TOF MS.

Even more popular are TOF MS, where pulsed converters are used to form pulsed ion packets out of continuous ion beams produced by ion sources like Electron Impact (EI), Electrospray (ESI), Atmospheric pressure ionization (APPI), atmospheric Pressure Chemical Ionization (APCI), Inductively couple Plasma (ICP) and gaseous (MALDI). Most common pulsed converters are orthogonal accelerators (WO9103071) and radiofrequency ion traps with pulsed radial ejection, lately used for ion injection into Orbitraps®. Two aspects of prior art are relevant to the present invention: (a) all ion sources and converters for TOF MS employ pulsed accelerating fields; (b) a significant portion of ion sources and converters are spatially wide, so that bypassing of ion sources and converters by ion packets returned after one pass (reflection or turn) becomes an issue.

The resolution of TOF MS has been substantially improved in multi-pass TOFMS (MPTOF), by reflecting ions multiple times between ion mirrors in multi-reflecting TOF (MRTOF) mass analysers [e.g. as described in SU1725289, U.S. Pat. Nos. 6,107,625, 6,570,152, GB2403063, U.S. Pat. No. 6,717,132, incorporated herein by reference], or by turning ions multiple times in electrostatic sectors in multi-turn TOF (MTTOF) mass analysers [e.g. as described in U.S. Pat. Nos. 7,504,620, 7,755,036, and M. Toyoda, et. al, J. Mass Spectrom. 38 (2003) 1125, incorporated herein by reference].

MPTOF analyzers are arranged to fold ion trajectories for substantial extension of the ion flight path (e.g. 10-50 m or more) within commercially reasonably sized (0.5-1 m) instruments. The ion path folding in MRTOF analysers is arranged with ion packet reflection in the X-direction combined with slow ion drift in the drift Z-direction, thus producing zigzag ion trajectories. The ion path folding in MTTOF is arranged with ion circular, oval or figure-of-eight loops in the X-Y plane combined with slow drift in the drift Z-direction, thus producing spiral ion motion. The term "pass" generalizes ion mirror reflections and ion turns. The resolving power (also referred as resolution) of MP-TOF analysers grows at larger number of passes N by reducing the effect of the initial time spread of ion packets and of the detector time spread.

Most MPTOF analysers employ two dimensional (2D) electrostatic fields in the XY-plane between electrodes, substantially elongated in the drift Z-direction. The 2D-fields of ion mirrors or sectors are carefully engineered to provide for isochronous ion motion and for spatial ion packet confinement in the XY-plane. By nature, the electrostatic 2D-fields have zero component $E_Z=0$ in the orthogonal drift Z-direction, i.e. they have no effect on the ion packets free propagation and its expansion in the drift Z-direction.

In earlier MPTOF schemes, the control over ion motion in the drift direction was arranged by the ion injecting mechanisms in ion sources or ion pulsed converters, defining the inclination angle of ion trajectory in the analyzer. In an attempt to increase MPTOF resolution by using denser folding of the ion trajectory, the injection angle $\alpha$ (to axis X) of ion packets shall be reduced, thus, requiring much lower energies of the injected continuous ion beam. Lower injection energies affect the ion beam admission into the OA and increase the ion packet angular divergence $\Delta\alpha$. Ions start hitting rims of the accelerator and ion detector, and may produce trajectories that overlap, thus confusing spectra.

To address those problems, multiple complex solutions have been proposed to define the ion drift advance per reflection, to prevent or compensate the angular divergence of ion packets, and to withstand various distortions, such as stray fields and mechanical distortions of analyzer electrodes: e.g. U.S. Pat. No. 7,385,187 proposed periodic lens and edge deflectors for MRTOF analysers; U.S. Pat. No. 7,504,620 proposed laminated sectors for MTTOF analysers; WO2010008386 and then US2011168880 proposed quasi-planar ion mirrors having weak (but sufficient) spatial modulation of mirror fields; U.S. Pat. No. 7,982,184 proposed splitting mirror electrodes into multiple segments for arranging $E_Z$ field; U.S. Pat. No. 8,237,111 and GB2485825 proposed electrostatic traps with three-dimensional fields, though without sufficient isochronicity in all three dimensions and without non-distorted regions for ion injection; WO2011086430 proposed first order isochronous Z-edge reflections by tilting ion mirror edge combined with reflector fields; U.S. Pat. No. 9,136,101 proposed bent ion MRTOF ion mirrors with isochronicity recovered by trans-axial lens. Though prior art solutions do solve the problem of controlling Z-motion, they have several drawbacks, comprising: (i) technical complexity; (ii) additional time aberrations, affecting resolution; (iii) limited length of ion packets and limited duty cycle and charge capacity of pulsed converters; and (iv) fixed arrangement with low tolerance to manufacturing faults. Those drawbacks become particularly problematic when trying to construct a compact and low cost MPTOF instrument for higher resolutions.

SUMMARY

From a first aspect the present invention provides a pulsed ion accelerator for a mass spectrometer comprising: a plurality of electrodes and at least one voltage supply arranged and configured to generate a wedge-shaped electric field region; wherein the ion accelerator is configured to apply a pulsed voltage to at least one of said electrodes for pulsing ions out of the ion accelerator, wherein the ions have a time front arranged in a first plane at the time the pulsed voltage is initiated, and wherein the ion accelerator is configured such that the pulsed ions pass through the wedge-shaped electric field region so as to cause the time front of the ions to be tilted at an angle to the first plane.

The above pulsed ion accelerator tilts the time front of the ions it pulses out. By introducing such a tilted time front, the pulsed ion accelerator is able to compensate for time front tilting that may occur at ion optical components of the mass spectrometer that are downstream of the pulsed ion accelerator. The embodiments are also able to introduce a relatively large time front tilt whilst altering the mean ion trajectory by only a relatively small angle.

For the avoidance of doubt, the time front of the ions may be considered to be a leading edge/area of ions in the ion packet having the same mass to charge ratio (and which may have the mean average energy).

The pulsed ion accelerator is an orthogonal accelerator.

The pulsed ion accelerator may be arranged to receive ions along a first axis and pulse the ions substantially orthogonally to the first axis.

The pulsed ion accelerator may comprise electrodes arranged and configured for generating said wedge-shaped electric field region therebetween such that equipotential field lines in the wedge-shaped electric field region are angled to each other so as to form the wedge-shape.

Therefore, the equipotential field lines may converge towards one another in a direction towards a first end of the wedge-shaped electric field region, and diverge away from one another in a direction towards a second opposite end of the wedge-shaped electric field region.

The first and second ends may be spaced apart in a direction substantially along said first axis along which ions are received.

Ions travelling through the wedge-shaped electric field region may be accelerated by the wedge-shaped electric field by an amount that increases as a function of distance towards the first end, since the equipotential field lines converge towards the first end. This may cause the time front of the ions to be tilted.

The pulsed ion accelerator may comprise one or more first electrode arranged in a first plane and one or more second electrode arranged in a second plane that is angled to the first plane so as to define the wedge-shaped electric field region between the one or more first electrode and one or more second electrode.

The pulsed ion accelerator may comprise one or more first electrode arranged in a first plane and a plurality of second electrodes arranged in a second plane, wherein the ion accelerator is configured to apply different voltages to different ones of the second electrodes so as to define the wedge-shaped electric field region between the one or more first electrode and the second electrodes.

This enables the time front tilt angle to easily be varied by varying the potentials applied to the second electrodes.

The first and second plane may be parallel.

The second electrodes may be connected by a resistive chain such that a voltage supply connected to the resistive chain applies different electrical potentials to the second electrodes.

The plurality of second electrodes may be arranged on a printed circuit board (PCB).

The one or more first electrodes may be a plurality of first electrodes, and the ion accelerator may be configured to apply different voltages to the first electrodes so as to define the wedge-shaped electric field region. This enables the time front tilt angle to be varied by varying the potentials applied to the first electrodes. The first electrodes may be connected by a resistive chain such that a voltage supply connected to the resistive chain applies different electrical potentials to the first electrodes. The first electrodes may be arranged on a printed circuit board (PCB).

PCB as used herein may refer to a component containing conductive tracks, pads and other features etched from, printed on, or deposited on one or more sheet layers of material laminated onto and/or between sheet layers of a non-conductive substrate.

In embodiments in which electrodes are arranged on a PCB, a resistive layer may be provide between the electrodes, so as to avoid the insulating material of the substrate from becoming electrically charged.

Embodiments are also contemplated in which at least some of the electrodes connected by the resistive chain are replaced by a resistive layer.

The pulsed ion accelerator may comprise electrodes spaced apart in a dimension for defining the wedge-shaped electric field region therebetween, and the ion accelerator may be configured to pulse ions in said dimension.

The electrodes for generating said wedge-shaped electric field region may be arranged so that equipotential field lines of the wedge-shaped electric field extend substantially in a first direction and the ion accelerator is configured to pulse the ions through the wedge-shaped electric field substantially transverse to the equipotential field lines.

The ion accelerator may be arranged and configured to receive ions travelling substantially in the first direction.

The ion accelerator may be arranged to receive ions at the wedge-shaped electric field region.

The ion accelerator may be arranged and configured to receive ions travelling in a first direction along a first axis that is substantially parallel to equipotential field lines of the wedge-shaped electric field.

The equipotential field lines of the wedge-shaped electric field may diverge, or converge, as a function of distance in the first direction.

Alternatively, the ion accelerator may be arranged to receive ions at an ion receiving region and then pulse the ions downstream into the wedge-shaped electric field region of the ion accelerator.

The pulsed ion accelerator may be configured to pulse said wedge-shaped electric field for pulsing ions out of the ion accelerator.

The pulsed ion accelerator may comprise an ion acceleration region downstream of the wedge-shaped electric field region for amplifying the time front tilt introduced by the wedge-shaped electric field.

The pulsed ion accelerator may comprise a voltage supply and electrodes configured to apply a static electric field in the ion acceleration region for accelerating the ions; and/or a voltage supply and electrodes configured to apply an electric field in the ion acceleration region having parallel equipotential field lines for accelerating the ions.

The pulsed ions may travel through the ion acceleration region substantially orthogonal to the parallel equipotential field lines.

The pulsed ion accelerator may comprise an ion deflector located downstream of the pulsed ion accelerator and configured to deflect the average ion trajectory of the ions, thereby tilting the angle of the time front of the ions received by the ion deflector. The wedge-shaped electric field region of the pulsed ion accelerator may be configured to tilt the time front of the ions passing therethrough so as to at least partially counteract the tilting of the time front by the ion deflector.

The angle of the time front may therefore be moved at least partially back towards the first plane (i.e. the angle the time front was at when the pulsed voltage was initiated) when the ions exit the ion deflector.

The initial mean ion energy of the ions prior to acceleration in the pulsed ion accelerator may be (significantly) smaller than the mean ion energy of the ions within said ion deflector.

It has been recognised that a conventional ion deflector inherently has a relatively high focusing effect on the ions, hence undesirably increasing the angular spread of the ion trajectories exiting the deflector, as compared to the angular spread of the ion trajectories entering the ion deflector. This may cause excessive spatial defocusing of the ions downstream of the focal point, resulting in ion losses and/or causing ions to travel significantly different path lengths through the spectrometer before they reach the detector. The mass resolution of the spectrometer may be adversely affected. Embodiments of the present invention provide an ion deflector configured to generate a quadrupolar field that controls the spatial focusing of the ions, e.g. so as to maintain substantially the same angular spread of the ions passing therethrough, or to allow only the desired amount of spatial focusing of the ions.

The pulsed ion accelerator may be one of: (i) a MALDI source; (ii) a SIMS source; (iii) a mapping or imaging ion source; (iv) an electron impact ion source; (v) a pulsed converter for converting a continuous or pseudo-continuous ion beam into ion pulses; (vi) an orthogonal accelerator; (vii) a pass-through orthogonal accelerator having an electrostatic ion guide; or (viii) a radio-frequency ion trap with pulsed ion ejection.

The present invention also provides a mass spectrometer comprising: a multi-pass time-of-flight mass analyser or electrostatic ion trap having the pulsed ion accelerator as described hereinabove, and electrodes arranged and configured so as to provide an ion drift region that is elongated in a drift direction (z-dimension) and to reflect or turn ions multiple times in an oscillating dimension (x-dimension) that is orthogonal to the drift direction.

The multi-pass time-of-flight mass analyser may be a multi-reflecting time of flight mass analyser having two ion mirrors that are elongated in the drift direction (z-dimension) and configured to reflect ions multiple times in the oscillation dimension (x-dimension), wherein the pulsed ion accelerator is arranged to receive ions and accelerate them into one of the ion mirrors. Alternatively, the multi-pass time-of-flight mass analyser may be a multi-turn time of flight mass analyser having at least two electric sectors configured to turn ions multiple times in the oscillation dimension (x-dimension), wherein the pulsed ion accelerator is arranged to receive ions and accelerate them into one of the sectors.

Where the mass analyser is a multi-reflecting time of flight mass analyser, the mirrors may be gridless mirrors.

Each mirror may be elongated in the drift direction and may be parallel to the drift dimension.

It is alternatively contemplated that the multi-pass time-of-flight mass analyser or electrostatic trap may have one or more ion mirror and one or more sector arranged such that ions are reflected multiple times by the one or more ion mirror and turned multiple times by the one or more sector, in the oscillation dimension.

The spectrometer may comprise an ion deflector located downstream of said pulsed ion accelerator, and that is configured to back-steer the average ion trajectory of the ions, in the drift direction, thereby tilting the angle of the time front of the ions received by the ion deflector.

The average ion trajectory of the ions travelling through the ion deflector may have a major velocity component in the oscillation dimension (x-dimension) and a minor velocity component in the drift direction. The ion deflector back-steers the average ion trajectory of the ions passing therethrough by reducing the velocity component of the ions in the drift direction. The ions may therefore continue to travel in the same drift direction upon entering and leaving the ion deflector, but with the ions leaving the ion deflector having a reduced velocity in the drift direction. This enables the ions to oscillate a relatively high number of times in the oscillation dimension, for a given length in the drift direction, thus providing a relatively high resolution.

The wedge-shaped electric field region of the pulsed ion accelerator may be configured to tilt the time front of the ions passing therethrough so as to at least partially counteract the tilting of the time front by the ion deflector.

The angle of the time front may therefore be moved at least partially back towards the first plane (i.e. the angle the time front was at when the pulsed voltage was initiated) when the ions exit the ion deflector.

The ion deflector may be configured to generate a quadrupolar field for controlling the spatial focusing of the ions in the drift direction.

It has been recognised that a conventional ion deflector inherently has a relatively high focusing effect on the ions, hence undesirably increasing the angular spread of the ion trajectories exiting the deflector, as compared to the angular spread of the ion trajectories entering the ion deflector. This may cause excessive spatial defocusing of the ions downstream of the focal point, resulting in ion losses and/or causing ions to undergo different numbers of oscillations in the spectrometer before they reach the detector. This may cause spectral overlap due to ions from different ion packets being detected at the same time. The mass resolution of the spectrometer may also be adversely affected. Such conventional ion deflectors are therefore particularly problematic in multi-pass time-of-flight mass analysers or multi-pass electrostatic ion traps, since a large angular spread of the ions will cause any given ion packet to diverge a relatively large amount over the relatively long flight path through the device. Embodiments of the present invention provide an ion deflector configured to generate a quadrupolar field that controls the spatial focusing of the ions in the drift direction, e.g. so as to maintain substantially the same angular spread of the ions passing therethrough, or to allow only the desired amount of spatial focusing of the ions in the z-direction.

The quadrupolar field for in the drift direction may generate the opposite ion focusing or defocusing effect in the dimension orthogonal to the drift direction and oscillation dimension. However, it has been recognised that the focal properties of MPTOF mass analyser (e.g. MRTOF mirrors) or electrostatic trap are sufficient to compensate for this.

The ion deflector may be configured to generate a substantially quadratic potential profile in the drift direction.

The ion deflector may back steer all ions passing therethrough by the same angle; and/or the ion deflector may control the spatial focusing of the ion packet in the drift direction such that the ion packet has substantially the same size in the drift dimension when it reaches an ion detector in the spectrometer as it did when it enters the ion deflector.

The ion deflector may control the spatial focusing of the ion packet in the drift direction such that the ion packet has a smaller size in the drift dimension when it reaches a detector in the spectrometer than it did when it entered the ion deflector.

At least one voltage supply may be provided that is configured to apply one or more first voltage to one or more electrode of the ion deflector for performing said back-steer and one or more second voltage to one or more electrode of the ion deflector for generating said quadrupolar field for said spatial focusing, wherein the one or more first voltage is decoupled from the one or more second voltage.

The ion deflector may comprise at least one plate electrode arranged substantially in the plane defined by the oscillation dimension and the dimension orthogonal to both the oscillation dimension and the drift direction (X-Y plane), wherein the plate electrode is configured back-steer the ions; and the ion deflector may comprise side plate electrodes arranged substantially orthogonal to the at least one plate electrode and that are maintained at a different potential to the plate electrode for controlling the spatial focusing of the ions in the drift direction.

The side plates may be Matsuda plates.

The at least one plate electrode may comprise two electrodes and a voltage supply for applying a potential difference between the electrodes so as to back-steer the average ion trajectory of the ions, in the drift direction.

The two electrodes may be a pair of opposing electrodes that are spaced apart in the drift direction.

However, it is contemplated that only the upstream electrode (in the drift direction) may be provided, so as to avoid ions hitting the downstream electrode.

The ion deflector may be configured to provide said quadrupolar field by comprising one or more of: (i) a trans-axial lens/wedge; (iii) a deflector with aspect ratio between deflecting plates and side walls of less than 2; (iv) a gate shaped deflector; or (v) a toroidal deflector such as a toroidal sector.

The ion deflector may be arranged such that it receives ions that have already been reflected or turned in the oscillation dimension by the multi-pass time-of-flight mass analyser or electrostatic ion trap; optionally after the ions have been reflected or turned only a single time in the oscillation dimension by the multi-pass time-of-flight mass analyzer or electrostatic ion trap.

The location of the deflector directly after the first ion mirror reflection allows yet denser ray folding The pulsed ion accelerator and ion deflector may tilt the time front so that it is aligned with the ion receiving surface of the ion detector and/or to be parallel to the drift direction (z-dimension).

The mass analyser or electrostatic trap may be an isochronous and/or gridless mass analyser or an electrostatic trap.

The mass analyser or electrostatic trap may be configured to form an electrostatic field in a plane defined by the oscillation dimension and the dimension orthogonal to both the oscillation dimension and drift direction (i.e. the XY-plane).

This two-dimensional field may have a zero or negligible electric field component in the drift direction (in the ion passage region). This two-dimensional field may provide isochronous repetitive multi-pass ion motion along a mean ion trajectory within the XY plane.

The energy of the ions received at the pulsed ion accelerator and the average back steering angle of the ion deflector may be configured so as to direct ions to an ion detector after a pre-selected number of ion passes (i.e. reflections or turns).

The spectrometer may comprise an ion source. The ion source may generate an substantially continuous ion beam or ion packets.

The pulsed ion accelerator may be a gridless orthogonal accelerator.

The pulsed ion accelerator has a region for receiving ions (a storage gap) and may be configured to pulse ions orthogonally to the direction along which it receives ions. The pulsed ion accelerator may receive a substantially continuous ion beam or packets of ions, and may pulse out ion packets.

The drift direction may be linear (i.e. a dimension) or it may be curved, e.g. to form a cylindrical or elliptical drift region.

The mass analyser or ion trap may have a dimension in the drift direction of: ≤1 m; ≤0.9 m; ≤0.8 m; ≤0.7 m; ≤0.6 m; or ≤0.5 m. The mass analyser or trap may have the same or smaller size in the oscillation dimension and/or the dimension orthogonal to the drift direction and oscillation dimension.

The mass analyser or ion trap may provide an ion flight path length of: between 5 and 15 m; between 6 and 14 m; between 7 and 13 m; or between 8 and 12 m.

The mass analyser or ion trap may provide an ion flight path length of: ≤20 m; ≤15 m; ≤14 m; ≤13 m; ≤12 m; or ≤11 m. Additionally, or alternatively, the mass analyser or ion trap may provide an ion flight path length of: ≥5 m; ≥6 m; ≥7 m; ≥8 m; ≥9 m; or ≥10 m. Any ranges from the above two lists may be combined where not mutually exclusive.

The mass analyser or ion trap may be configured to reflect or turn the ions N times in the oscillation dimension, wherein N is: ≥5; ≥6; ≥7; ≥8; ≥9; ≥10; ≥11; ≥12; ≥13; ≥14; ≥15; ≥16; ≥17; ≥18; ≥19; or ≥20. The mass analyser or ion trap may be configured to reflect or turn the ions N times in the oscillation dimension, wherein N is: ≤20; ≤19; ≤18; ≤17; ≤16; ≤15; ≤14; ≤13; ≤12; or ≤11. Any ranges from the above two lists may be combined where not mutually exclusive.

The spectrometer may have a resolution of: ≥30,000; ≥40,000; ≥50,000; ≥60,000; ≥70,000; or ≥80,000.

The spectrometer may be configured such that the pulsed ion accelerator receives ions having a kinetic energy of: ≥20 eV; ≥30 eV; ≥40 eV; ≥50 eV; ≥60 eV; between 20 and 60 eV; or between 30 and 50 eV. Such ion energies may reduce angular spread of the ions and cause the ions to bypass the rims of the orthogonal accelerator.

The spectrometer may comprise an ion detector.

The detector may be an image current detector configured such that ions passing near to it induce an electrical current in it. For example, the spectrometer may be configured to oscillate ions in the oscillation dimension proximate to the detector, inducing a current in the detector, and the spectrometer may be configured to determine the mass to charge ratios of these ions from the frequencies of their oscillations (e.g. using Fourier transform technology). Such techniques may be used in the electrostatic ion trap embodiments.

Alternatively, the ion detector may be an impact ion detector that detects ions impacting on a detector surface. The detector surface may be parallel to the drift dimension.

The ion detector may be arranged between the ion mirrors or sectors, e.g. midway between (in the oscillation dimension) opposing ion mirrors or sectors.

The present invention also provides a method of mass spectrometry comprising: providing a pulsed ion accelerator or mass spectrometer as described herein; and applying a pulsed voltage to at least one of said electrodes so as to pulse ions out of the ion accelerator, wherein the ions have a time front arranged in a first plane at the time the pulsed voltage is initiated, and wherein the ions pass through the wedge-shaped electric field region so as to cause the time front of the ions to be tilted at an angle to the first plane.

Herein there are proposed several ion optical elements, believed to be novel at least for MRTOF field:

I. A combination of a wedge pulsed field with post-acceleration in a "flat" (that is independent of the Z-coordinate) field. Such optical element, further referred as "amplifying wedge accelerator" appears a powerful, flexible and electrically adjustable tool for tilting time fronts of ion packets while introducing very minor ion ray steering;

II. A compensated deflector, incorporating quadrupolar field, e.g. produced by Matsuda plates. The compensated deflector overcomes the over-focusing of conventional deflectors in MPTOF, so as provides an opportunity for controlled ion packet focusing and defocusing; A set of compensated deflectors is used to bypass rims.

Further, the inventor has realized that applying a combination of compensated deflectors with amplifying wedge fields to MPTOF allows reaching: (a) spatial ion packet focusing Z|Z=0 onto detector; and (b) mutual compensation of multiple aberrations, including (i) first order time-front tilt T|Z, (ii) chromatic angular spread $\alpha|\delta$ and, accounting analyzer properties, most of Y-related time-of-flight aberrations.

In application to orthogonal accelerators, there are achieved: (a) elevated energies of ion beams at the entrance of orthogonal accelerators for improved sensitivity and for reduced angular divergence $\Delta\alpha$ of ion packets; (b) dense folding of ion rays at small inclination angles for higher resolution of MPTOF.

The proposed schemes and some embodiments were tested and are presented here in ion optical simulations, which have verified the stated ion optical properties, including flexible tuning and compensation of misalignments; so as to confirm an ability of reaching a substantially improved combination of resolution and sensitivity within a compact MPTOF systems. As an example, FIG. 7 illustrates a compact 250×450 mm MRTOF system reaching resolution over 40,000.

Embodiments provide an ion injection mechanism into an isochronous electrostatic mass spectrometer, comprising:

(a) a pulsed acceleration stage with a wedge-type electric field;

(b) a following static acceleration stage with a flat field;

(c) at least one downstream ion deflector or a trans-axial deflector for ion ray steering;

(d) wherein the initial mean ion energy prior to pulsed acceleration is much smaller compared to the ion energy within said at least one deflector; and (e) wherein the ion ray steering angle in said deflector and parameters of said accelerating stages are arranged and electrically adjusted to provide for mutual compensation of the ion packets time front tilt angle past said deflector.

Preferably, said at least one deflector may comprise means for generating an additional quadrupolar field for independent control over ion ray's steering angle and focusing or defocusing.

Preferably, said mass spectrometer may comprise at least one field-free space and at least one ion mirror and/or at least one electric sector.

Preferably, said mass spectrometer may comprise one of the group: (i) a time-of-flight mass spectrometer; (ii) an open ion trap; and (iii) an ion trap.

Embodiments provide a method of ion injection into an electrostatic field of an isochronous mass spectrometer, comprising the following steps:

(a) pulsed ion acceleration within a wedge-type electric field;

(b) post-acceleration within a flat electrostatic field;

(c) ion ray steering by at least one downstream ion deflecting field a trans-axial wedge deflecting field;

(d) wherein the initial mean ion energy prior to pulsed acceleration is much smaller compared to the ion energy within said at least one deflector; and (e) wherein the ion ray steering angle in said deflector and parameters of said accelerating stages are arranged and electrically adjusted to provide for mutual compensation of the ion packets time-front tilt angle past said deflector.

Preferably, the method may further comprise a step of adding a quadrupolar field to said deflecting field for independent control over ion ray's steering angle and focusing or defocusing.

Preferably, said field of isochronous mass spectrometer may comprise at least one field-free space and at least one ion reflecting field of ion mirror and/or at least one deflecting field of electric sector.

Preferably, said field of mass spectrometer may be arranged for one type of mass spectral analysis of the group: (i) a time-of-flight mass analysis; (ii) an analysis of ion oscillation frequencies within an ion electrostatic trap or an open ion trap.

Embodiments provide an isochronous electrostatic mass spectrometer comprising:

(a) An ion source, generating ions;

(b) An electrostatic analyzer substantially elongated in the first Z-axis and forming a two-dimensional electrostatic field in the orthogonal XY-plane for isochronous ion passage along a mean ion trajectory at an inclination angle $\alpha$ to the X-axis;

(c) An ion accelerator with a pulsed accelerating stage, followed by a DC acceleration stage;

said accelerator is arranged for emitting ion packets at an inclination angle $\alpha_0$ to the X axis;

(d) a time-of-flight detector or an image current detector;

(e) At least one electrically adjustable electrostatic deflector for ion trajectory steering at angle $\psi$, associated with equal tilting of ion packets time front;

(e) Wherein at least one electrode of said accelerator is tilted to the Z-axis to form an electrically adjustable wedge electrostatic field within said pulsed accelerating stage for adjusting of the time-front tilt angle $\gamma$ of said ion packets relative to the Z-axis, associated with the steering of ion trajectories at smaller (relative to said angle $\gamma$) inclination angle $\varphi$;

(f) Wherein said steering angles $\psi$ and $\varphi$ are arranged for either denser folding of major portion of ion trajectories at inclination angles $\alpha$ being smaller than said angle $\alpha_0$, and/or for bypassing rims of said accelerator or deflector, and/or for reverting ion drift motion within said analyzer this way extending ion flight path and resolution; and (g) Wherein said time-front tilt angles $\gamma$ and said ion steering angles $\psi$ are electrically adjusted for mutual compensation of ion packets time front tilt angle at the detector plane, this way accounting unintentional misalignments of electrodes of the spectrometer.

Preferably, for the purpose of controlling spatial defocusing or focusing of said at least one deflector, an additional quadrupolar field may be formed within said deflector by at least one electrode structure of the group: (i) Matsuda plates; (ii) gate shaped deflecting electrode; (iii) side shields of the deflector with the aspect ratio under 2; (iv) toroidal sector deflection electrodes; and (v) additional electrode curvature within a trans-axial wedge deflector.

Preferably, said accelerator may be part of one pulsed ion source of the group: (i) a MALDI source; (ii) a SIMS source; (iii) a mapping or imaging ion source; and (iv) an electron impact ion source.

Preferably, said accelerator may be part of one pulsed converter of the group: (i) an orthogonal accelerator; (ii) a pass-through orthogonal accelerator with an electrostatic ion guide; and (iii) a radio-frequency ion trap with radial pulsed ion ejection.

Embodiments provide a method of time-of-flight mass spectral analysis comprising the following steps:

(a) generating ions in an ion source;

(b) within an electrostatic analyzer substantially elongated in the first Z-axis, forming a two-dimensional electrostatic field in the orthogonal XY-plane for isochronous ion passage along a mean ion trajectory at an inclination angle $\alpha$ to the X-axis;

(c) forming a pulsed accelerating field, followed by a DC acceleration field, arranged for emitting of ion packets at an inclination angle $\alpha_0$ to the X axis;

(d) detecting ions on a time-of-flight detector;

(e) Ion trajectory steering at angle cu associated with equal tilting of ion packets time-front by least one electrically adjustable electrostatic deflector;

(e) Forming an electrically adjustable wedge electrostatic field within said pulsed accelerating stage for adjusting of the time front tilt angle $\gamma$ of said ion packets relative to the Z-axis, associated with the steering of ion trajectories at smaller (relative to said angle $\gamma$) inclination angle $\varphi$, arranged by tilting relative to the Z-axis of at least one electrode of said accelerator;

(f) Wherein said steering angles $\psi$ and $\varphi$ are arranged for either denser folding of major portion of ion trajectories at inclination angles $\alpha$ being smaller than said angle $\alpha_0$, and/or for bypassing rims of said accelerator or deflector, and/or for reverting ion drift motion within said analyzer this way extending ion flight path and resolution; and (g) Wherein said time-front tilt angles $\gamma$ and said ion steering angles $\psi$ are electrically adjusted for mutual compensation of ion packets time front tilt angle at the detector face, this way accounting misalignments of electrodes of spectrometer.

Preferably, for the purpose of controlling spatial defocusing or focusing of said at least one deflector, an additional quadrupolar field may be formed within said deflector by at least one electrode structure of the group: (i) Matsuda plates; (ii) gate shaped deflecting electrode; (iii) side shields of the deflector with the aspect ratio under 2; (iv) toroidal sector deflection electrodes; and (v) additional electrode curvature within a trans-axial wedge deflector.

Preferably, said ion acceleration step may be part of one pulsed ion step of the group: (i) a MALDI ionization; (ii) a SIMS ionization; (iii) an ionization with mapping or imaging of analyzed surfaces; and (iv) an electron impact ionization.

Preferably, said accelerator step may be part of one pulsed conversion step of the group: (i) an orthogonal acceleration; (ii) a pass-through orthogonal acceleration assisted by ion beam guidance by an electrostatic field of an ion guide; and (iii) a radio-frequency ion trapping with radial pulsed ion ejection.

BRIEF DESCRIPTION OF THE DRAWINGS

Various embodiments will now be described, by way of example only, and with reference to the accompanying drawings in which.

DETAILED DESCRIPTION

Figure 1:
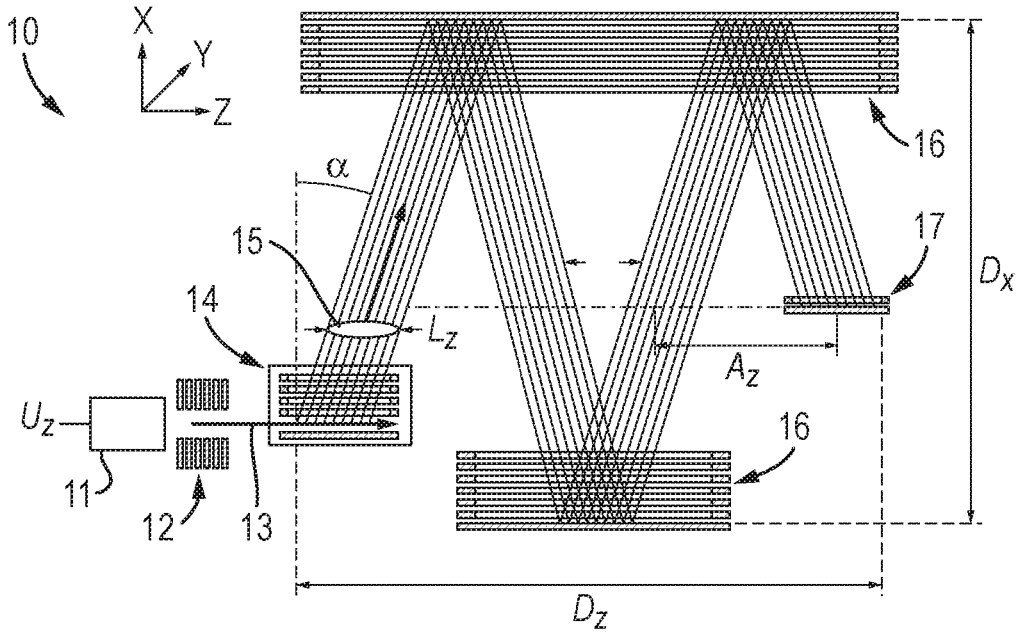
Fig. 1 Prior Art
FIG. 1 shows prior art U.S. Pat. No. 6,717,132 planar multi-reflecting TOF with gridless orthogonal pulsed accelerator OA.

Referring to FIG. 1, a prior art multi-reflecting TOF instrument 10 according to U.S. Pat. No. 6,717,132 is shown having an orthogonal accelerator (OA-MRTOF). The MRTOF instrument 10 comprises: an ion source 11 with a lens system 12 to form a substantially parallel ion beam 13; an orthogonal accelerator (OA) 14 with a storage gap to admit the beam 13; a pair of gridless ion mirrors 16, separated by field-free drift region, and a detector 17. Both OA 14 and mirrors 16 are formed with plate electrodes having slit openings, oriented in the Z-direction, thus forming a two dimensional electrostatic field, symmetric about the XZ symmetry plane (also denoted as s-plane). Accelerator 14, ion mirrors 16 and detector 17 are parallel to the Z-axis.

In operation, ion source 11 generates continuous ion beam. Commonly, ion sources 11 comprise gas-filled radio-frequency (RF) ion guides (not shown) for gaseous dampening of ion beams. Lens 12 forms a substantially parallel continuous ion beam 13, entering OA 14 along the Z-direction. Electrical pulse in OA 14 ejects ion packets 15. Packets 15 travel in the MRTOF analyser at a small inclination angle $\alpha$ to the x-axis, which is controlled by the ion source bias $U_Z$.

Figure 2:
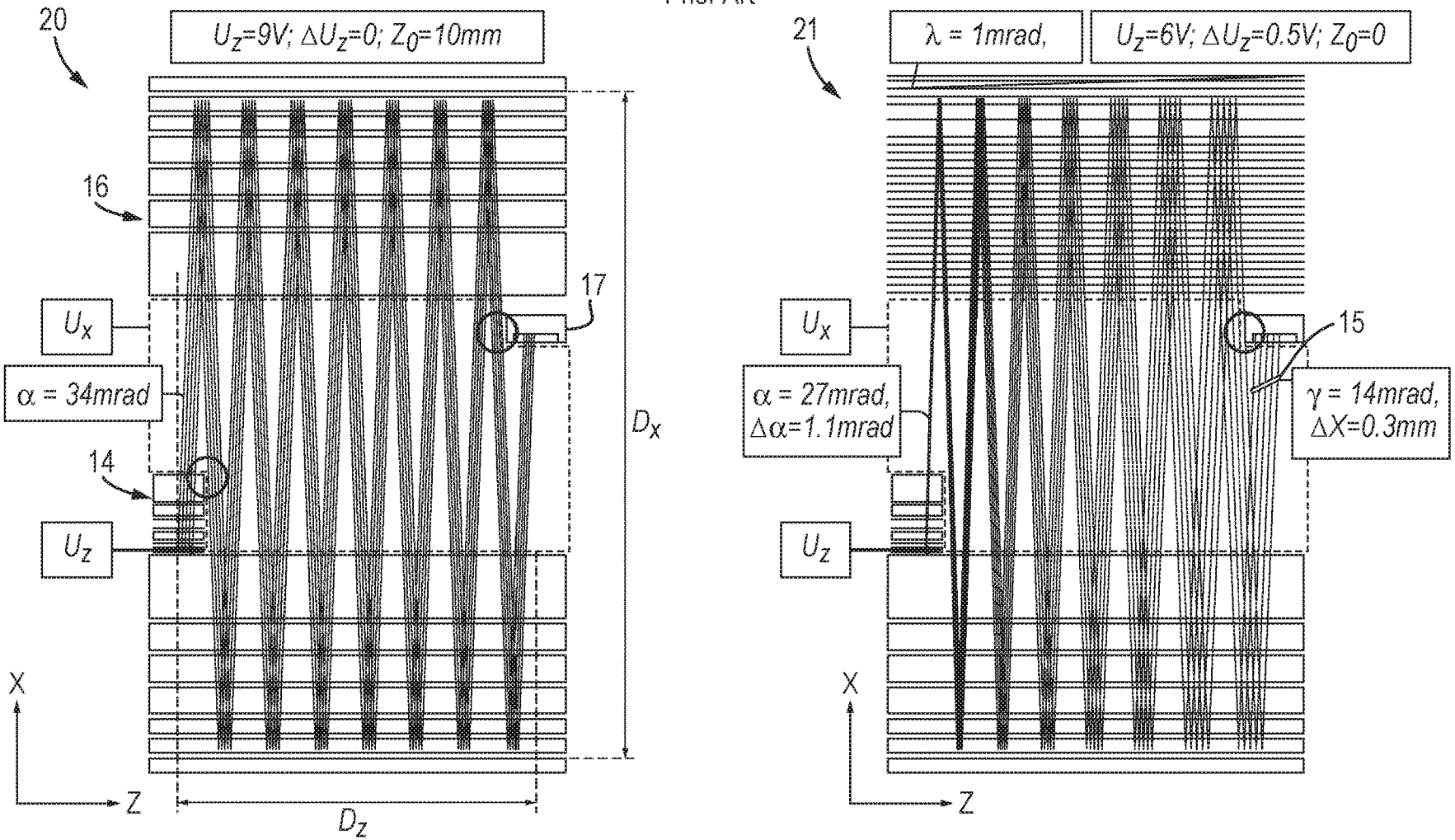
Fig. 2 Prior Art
FIG. 2 illustrates problems of dense trajectory folding set by mechanical precision of the analyzer of FIG. 1.

Referring to FIG. 2, simulation examples 20 and 21 are shown that illustrate multiple problems of prior art MRTOF instruments 10, if pushing for higher resolutions and denser ion trajectory folding. Exemplary MRTOF parameters were used, including: $D_X$=500 mm cap-cap distance; $D_Z$=250 mm wide portion of non-distorted XY-field; acceleration potential is $U_X$=8 kV, OA rim=10 mm and detector rim=5 mm.

In the Example 20, to fit 14 ion reflections (i.e. L=7 m ion flight path) the source bias is set to $U_Z$=9V. Parallel ion rays with an initial ion packet length in the z-dimension of $Z_0$=10 mm and no angular spread $\Delta\alpha$=0 start hitting rims of OA 14 and of detector 17. In Example 21, the top ion mirror is tilted by $\lambda$=1 mrad, representing realistic overall effective angle of mirror tilt, considering built up faults of stack assemblies, standard accuracy of machining and moderate electrode bend by internal stress at machining. Every "hard" ion reflection in the top ion mirror then changes the inclination angle $\alpha$ by 2 mrad. The inclination angle $\alpha$ grows from $\alpha_1$=27 mrad to $\alpha_2$=41 mrad, gradually expanding central trajectory. To hit the detector after N=14 reflections, the source bias has to be reduced to $U_Z$=6V. The angular divergence is amplified by mirror tilt and increase the ion packets width to $\Delta Z$=18 mm, inducing ion losses on the rims. Obviously, slits in the drift space may be used to avoid trajectory overlaps and spectral confusion, however, at a cost of additional ionic losses.

In example 21, the inclination of ion mirror introduces yet another and much more serious problem. The time-front 15 of the ion packet becomes tilted by angle $\gamma$-14 mrad in front of the detector. The total ion packet spreading in the time-of-flight X-direction $\Delta X=\Delta Z*\gamma$=0.3 mm limits mass resolution to $R<L/2\Delta X$=11,000 at L=7 m flight path, which is too low (for example compared to the desired R=80,000). To avoid the limitation, the electrode precision has to be brought to non-realistic level: $\lambda<0.1$ mrad, translated to better than 10 um accuracy and straightness of individual electrodes.

Summarizing problems of prior art MRTOF analysers, attempts of increasing flight path require much lower specific energies $U_Z$ of the continuous ion beam and cause larger angular divergences $\Delta\alpha$ of the ion packets, which induce ion losses on component rims and may produce spectral overlaps. Importantly, small mechanical imperfections strongly affect MRTOF resolution and require unreasonably high precision.

Figure 3:
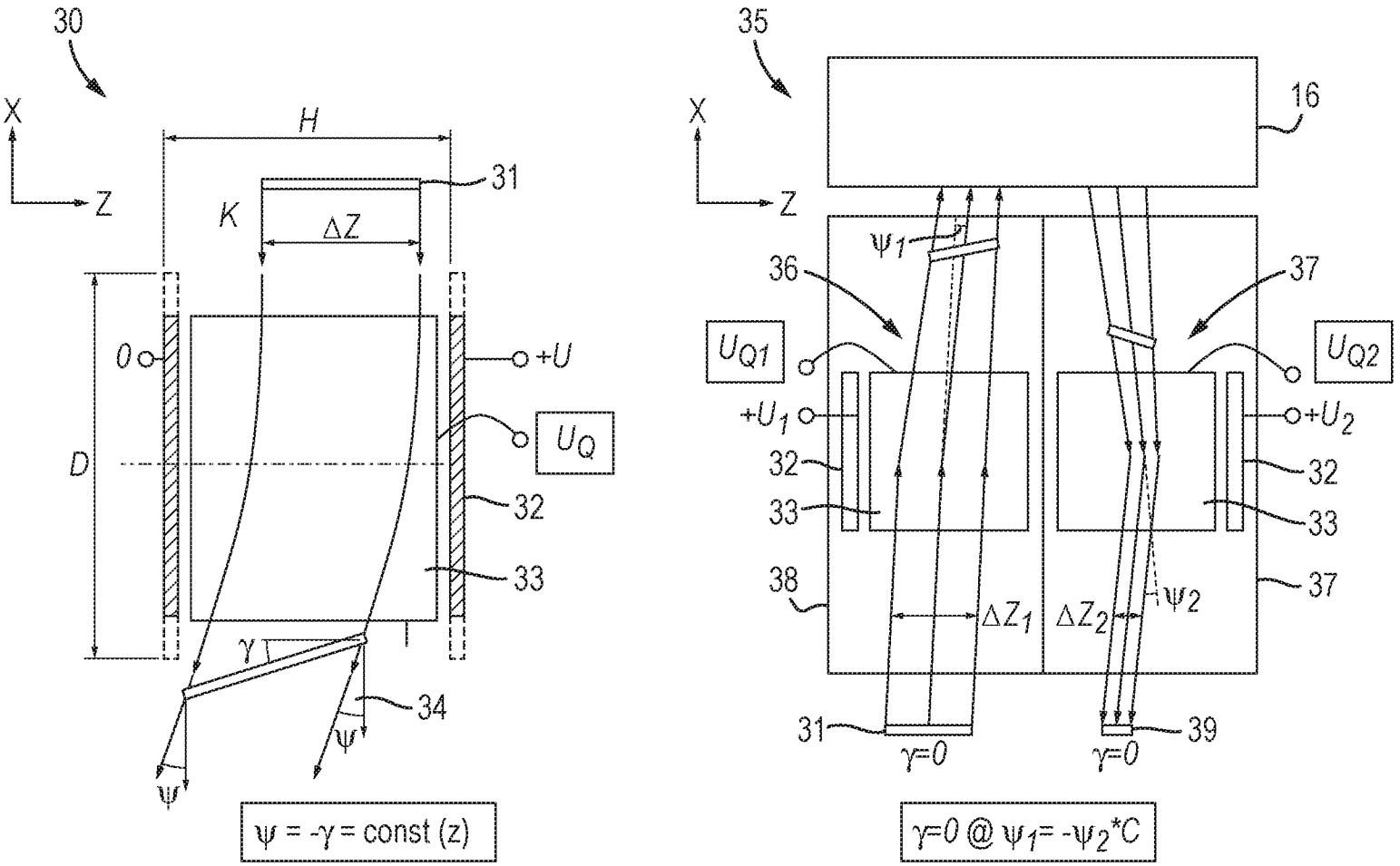
FIG. 3 shows a novel deflector of an embodiment of the present invention, compensated by additional quadrupolar field for controlled spatial focusing.

Referring to FIG. 3, there is proposed a compensated deflector 30 to steer ion rays while overcoming the over-focusing effects of conventional deflectors by incorporating a quadrupolar field (e.g. $E_Q=-2U_Q z/H^2$) in addition to the ion deflection field (e.g. $E_Z$=U/H). Conventional ion deflectors formed by opposing plate electrodes cause ions travelling at different positions between them to be deflected at different angles, causing angular dispersion of the ions and downstream over-focusing. The exemplary compensated deflector 30 according to embodiments of the present invention comprises a pair of deflection plates 32 spaced apart by distance H and having a potential difference U therebetween. The deflector 30 has side plates 33 at a different potential $U_Q$, known as Matsuda plates (e.g. in electrostatic sector fields). The additional quadrupolar field provides the first order compensation for angular dispersion that would be otherwise caused by the deflection plates 32 (i.e. as is problematic with conventional deflectors). The compensated deflector 30 is capable of steering ions by the same angle $\psi$ (relative to its trajectory when entering the deflector) regardless of the Z-coordinate of the ion in the deflector, tilts the time front 31 by angle $\gamma=-\psi$, is capable of compensating the over-focusing (e.g. $F\rightarrow\infty$) while avoiding bending of the time front (such bending being typical for conventional deflectors), or alternatively is capable of controlling the focal distance F independent of the steering angle $\psi$.

$$\psi=D/2H*U/K;\ \gamma=-\psi=\text{const}\ (z) \qquad \text{(Eq. 1)}$$

Alternatively, compensated deflectors may be used that are trans-axial (TA) deflectors, e.g. formed by wedge electrodes such as those described herein in relation to the pulsed orthogonal accelerator. By "compensated", it is meant that the angular dispersion of the ions caused by the ion deflection may be compensated for, e.g. by the quadrupolar field. Embodiments of the invention propose using a first order correction, produced by an additional curvature of TA-wedge. Controlled focusing/defocusing may also be generated by combination of the TA-wedge and TA-lens, arranged separately or combined into a single TA-device. For a narrower range of deflection angles, the compensated deflector may be arranged with a single potential while selecting the size of Matsuda plates or with a segment of toroidal sector.

Compensated deflectors perform well with MRTOF or MPTOF analysers. The quadrupolar field in the Z-direction generates an opposite focusing or defocusing field in the transverse Y-direction. Below simulations prove that the focal properties of MPTOF analyzers are sufficient to compensate for the Y-focusing of deflectors 30 without any significant TOF aberrations.

Again referring to FIG. 3, an embodiment 35 with a pair of compensated deflectors 36 and 37 each comprise: a single deflecting plate 32, a shield 38 at drift potential and Matsuda plate 33. Deflectors 36 and 37 may be spaced by one ion reflection from an ion mirror 16. In other words, the ions may undergo only a single ion mirror reflection between passing through deflector 36 and deflector 37. Since Matsuda plates allow achieving both focusing and defocusing, the pair of deflectors 36 and 37 may be arranged for telescopic compression of ion packets 31 to 39 with the factor of compression being given by $\Delta Z_1/\Delta Z_2$=C1, achieved at mutual compensation of the time front steering angle $\gamma$=0, equivalent to T|Z=0 if adjusting steering angles as $\psi_1=\psi_2$*C1. Preferably pair of deflectors 36 and 37 provide for parallel-to-parallel ray transformation, which provides for mutual compensation of the time-front curvature, equivalent to T|ZZ=0. Then the compression factor of the second deflector 37 may be considered as C2=1/C1.

$$\gamma=0 \text{ and } T|Z=0 \text{ at } \psi_1=\psi_2*C1 \qquad \text{(Eq. 2)}$$

$$T|ZZ=0, \text{ if } C1*C2=1 \qquad \text{(Eq. 3)}$$

Thus, using transformation of the Z-width of ion packets by compensated deflectors 37,37 allows adjusting the overall time front tilt angle after passing through a set of deflectors independent of the summary deflecting angle induced by this set.

Figure 4:
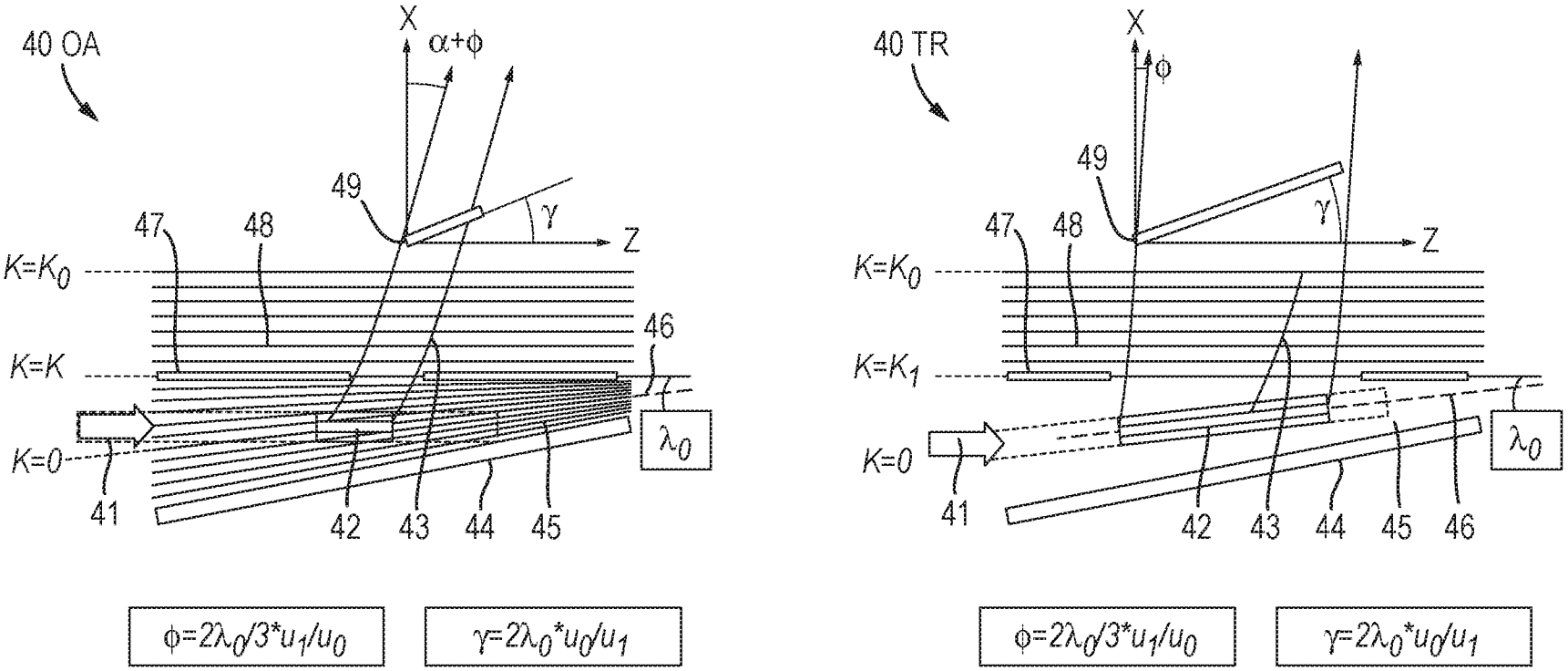
FIG. 4 shows a novel wedge accelerator of an embodiment of the present invention, designed for flexible control over the tilt angle of ion packets' time front

Referring to FIG. 4, a novel orthogonal accelerator (OA) 40 according to an embodiment of the present invention is proposed, incorporating a wedge ion accelerating field in the area of stagnated ion packets, combined with a flat (that is independent of Z coordinate) ion accelerating field, thus forming an "amplifying wedge field". The amplifying wedge field allows electronically controlling the tilt angle $\gamma$ of ion packets' time front whilst introducing only a small steering angle $\phi$ of ion rays (relative to the x-axis).

An exemplary orthogonal accelerator 40 comprises: a region of pulsed wedge field 45, arranged between a tilted push electrode 44 and ground plate 47 aligned with the Z-axis; and a flat DC accelerating field 48 formed by electrodes parallel to the Z-axis. Field 48 may have accelerating and decelerating regions for producing low time spread and spatial ion focusing of ion packets (e.g. in the XY-plane), however, all equi-potentials of field 48 may stay parallel to the Z-axis.

In operation, a continuous ion beam 41 enters along the Z-axis at specific ion energy $U_Z$, e.g. defined by voltage bias of an upstream RF ion guide. Preferably ion beam angular divergence, spatial expansion and beam initial position are controlled by some radial confinement means that may be selected, for example, from the group of: (i) a radiofrequency rectilinear multipolar ion guide; (ii) an electrostatic quadrupolar ion guide with ion beam compression in the X-direction; (iii) an electrostatic periodic lens; and (iv) proposed in a co-pending application, an electrostatic ion guide with quadupolar field being spatially alternated along the Z-axis. An electrical pulse may be applied periodically to the push plate 44, ejecting a portion of the beam 41 through an aperture in electrode 47, thus forming an ion packet with starting time-front 42, which crosses a starting equipotential 46 that is tilted at the angle $\lambda_0$ to the x-axis. Ions start with zero mean energy in the X-direction K=0, at the exit of wedge field 45 ions gain specific energy $K_1$ and at the exit of DC field 48 gains the energy $K_0$. Assuming small angles $\lambda_0$ of equipotential 46 (in further examples 0.5 deg), beam thickness of at least $\Delta X>1$ mm and moderate ion packet length (examples use $Z_0=10$ mm), the $\lambda_0$ tilt of starting equipotential 46 produces negligible corrections onto energy spread of ions in the x-direction $\Delta K$ of ion packet 49.

By applying trivial mathematics a non-expected and previously unknown result was arrived at: in accelerator 40 with amplifying wedge accelerating field, the time front tilt angle relative to the z-axis ($\gamma$) and the ion steering angle $\phi$ introduced by the wedge field are controlled by the energy factor $K_0/K_1$ as:

$$\gamma=2\lambda^*(K_0/K_1)^{0.5}=2\lambda^*u_0/u_1 \quad \text{(Eq. 4)}$$

$$\phi=2\lambda/3^*(K_1/K_0)^{0.5}=2\lambda/3^*u_1/u_0 \quad \text{(Eq. 5)}$$

$$\text{i.e. } \gamma/\phi=3K_0/K_1>>1 \quad \text{(Eq. 6)}$$

where $K_1$ and $K_0$ are mean ion kinetic energies at the exit of the wedge field 45 (index 1) and at the exit of flat field 48 (index 0) respectively, and $u_1$ and $u_0$ are the corresponding mean ion velocities.

Thus, novel accelerators with amplifying wedge field allow (i) operating with (e.g. continuous) ion beams introduced along the Z-axis, which allows convenient instrumental arrangements; (ii) tilting ion packets time front to a substantial angle $\gamma$, which may then be used for compensation of the time-front tilt in one or more ion deflector; (iii) controlling tilt angle electronically, either by adjusting the pulse potential or by minor steering of the (e.g. continuous) ion beam between various starting equipotential lines.

Again referring to FIG. 4, similar embodiment 40TR is proposed for an ion trap converter, having the same (as embodiment 40 OA) reference numbers for accelerator components. The trap 40TR may be arranged for ion through passage or for ion trapping in the Z-direction, where 41 is either an ion beam or an ion cloud correspondingly. In both cases one of the same (as in 40OA) means for radial ion confinement may be used, for example: (i) a radiofrequency rectilinear multipolar ion guide; (ii) an electrostatic quadrupolar ion guide with ion beam compression in the X-direction; (iii) an electrostatic periodic lens; or (iv) proposed in a co-pending application, an electrostatic ion guide with quadupolar field being spatially alternated along the Z-axis.

Ion injection into an MRTOF analysers may be improved by using higher energies of continuous ion beam for improving the ion beam admission into an orthogonal accelerator (OA) and for reducing angular divergence of ion packets in the MRTOF analyser. For higher MRTOF resolution, ion trajectories may be compact folded by using back steering of ion packets, achieved with a deflector. To compensate for the time front tilt produced by the deflector, it is proposed to use an amplifying wedge accelerating field such as that described above in the OA.

Figure 5:
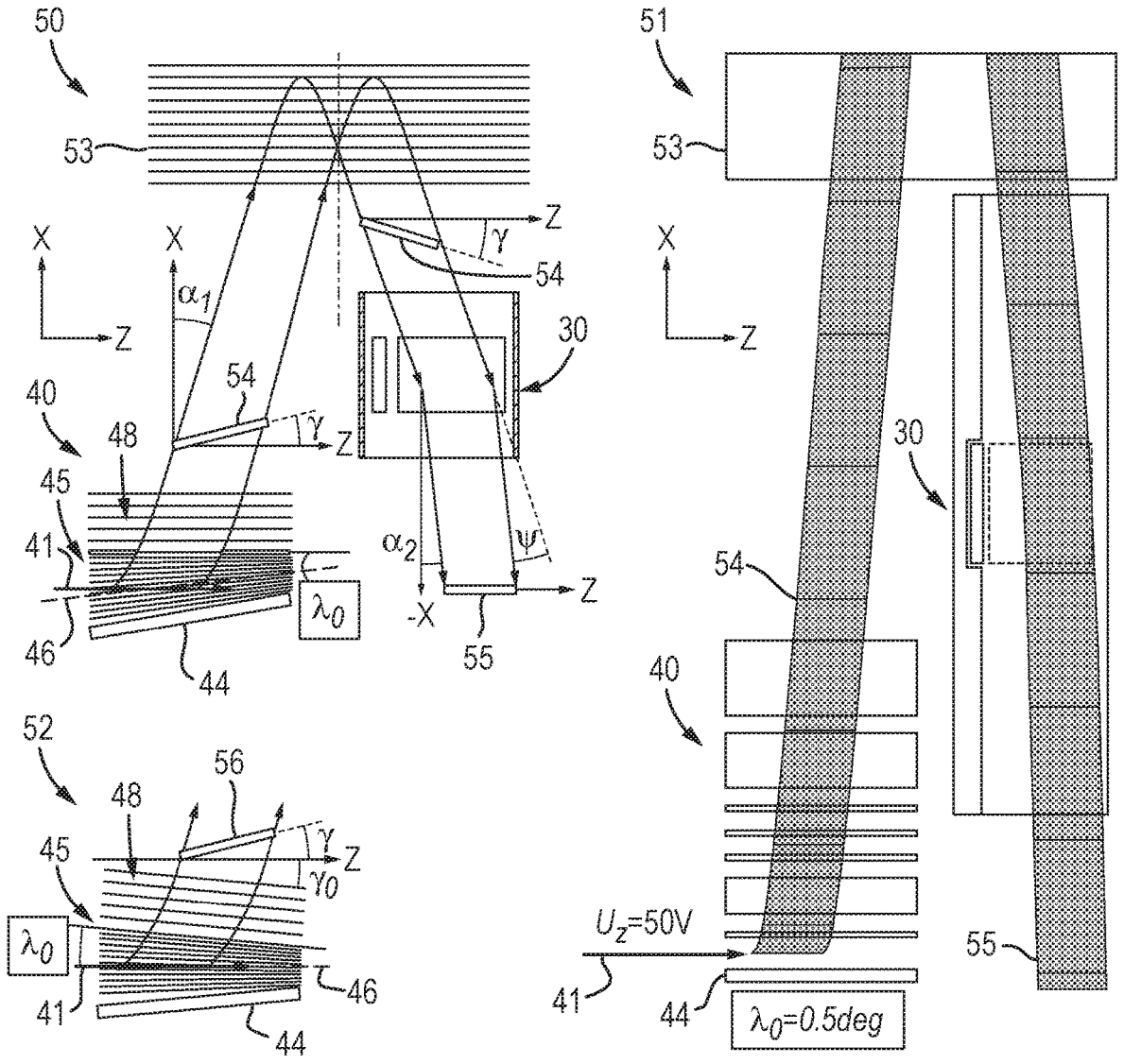
FIG. 5 shows a balanced injection mechanism of an embodiment of the present invention employing the balanced deflector of FIG. 3 and wedge accelerator of FIG. 4 for controlling the inclination angle of ion packets while compensating the time-front tilt.

Referring to FIG. 5, embodiments 50 of the ion injection mechanism into the MRTOF analyser of embodiments of the present invention comprise: a planar ion mirror 53 with 2D XY-field, extended in the Z-direction; an orthogonal accelerator 40 with "flat" DC acceleration field 48 aligned with Z-axis and a wedge accelerating field 45 produced by tilted push plate 44; and a compensated deflector 30, located along the ion path and after first ion mirror reflection. Deflector 30 may correspond to the one of FIG. 3 and the accelerator 40 may correspond to one of those in FIG. 4.

The operation of embodiment 50 is illustrated by simulation example 51, showing time fronts 54 and 55 crossing ion rays. Continuous ion beam 41 at specific energy (e.g. $U_Z=57$V) propagates along the Z-axis to cross starting (K=0) equipotential 46, which is tilted at the angle $\lambda_0$ (e.g. $\lambda_0=0.5$ deg) to the z-axis, with push plate 44 being tilted by 1 deg to the z-axis. Pulsed wedge field 45 accelerates ions to mean energy $K_1$ (e.g. $K_1=800$V), and flat field 48 to $K_0$ (e.g. $K_0=8$ kV), thus producing an amplifying factor $K_0/K_1\cong10$. The amplifying wedge tilts the ion packets time front 54 at a large angle [e.g. $\gamma=2\lambda_0*(K_0/K_1)^{0.5}\cong6\lambda_0$], while having a small deflection effect on the trajectory of the ion ray relative to the x-axis (as compared to if a conventional non-wedged and untilted OA was used). For example, the OA may result in an angle $\alpha_1=\alpha_0-\phi=4.7$ deg (where $\phi\cong0.2$ deg is the deflection angle caused by the wedged field). In other words, the ion rays are inclined almost at natural inclination angle $\alpha_0=(U_Z/U_X)^{0.5}=4.9$ deg.

After the first ion mirror reflection, deflector 30 steers ion rays by angle $\psi=-\gamma=-3.2$ deg (in the x-z plane), thus reducing the inclination angle to the x-direction to $\alpha_2=\alpha_1-\psi=1.5$ deg, while aligning the ion packets time front 55 parallel with the Z-axis, i.e. $\gamma=0$. Much higher specific energies of the ion beam (e.g. $U_Z=57$V as compared to 9V in the prior art) improves the ion admission into the OA and reduces the angular divergence $\Delta\alpha$ of ion packets, allowing denser folding of ion trajectories at smaller inclination angles, e.g. here at $\alpha_2=\alpha_1-\psi=1.5$ deg (as compared to the natural inclination angle $\alpha_0=4.9$ deg).

Table 1 below summarizes the equations for angles within the individual deflector 30 and wedge accelerator 40. Table 2 below presents conditions for compensation of the first order time-front tilt (T|Z=0) and of the chromatic spread of Z-velocity ($\alpha$|K=0). It is of significant importance that both compensations are achieved simultaneously. This is a new finding by the inventor. The pair of wedge accelerator 40 and deflector 30 compensate multiple aberrations, including the first order time front tilt, the chromatic angular spread and, accounting focusing properties of gridless ion mirrors in example 51, the angular and spatial spreads of ion packets in the Y-direction.

TABLE 1

| | Time-front Tilt Angle | Rays Steering Angle | Chromatic dependence of Z-velocity d(Δw)/dδ |
|---|---|---|---|
| Wedge Accelerator | $\gamma_0^{(OA)} = 2\lambda_0\sqrt{\frac{K_0}{K_1}}$ | $\varphi^{(OA)} \approx +\frac{2\lambda_0}{3}\sqrt{\frac{K_1}{K_0}}$ | $\lambda_0 u_0\sqrt{\frac{K_0}{K_1}}$ |
| Deflector | $-\psi_0$ | $\psi_0$ | $-\frac{1}{2}u_0\psi_0$ |

TABLE 2

| | Condition for the 1st order Time-front Tilt Compensation | Condition for Compensating Chromatic Spread of Z-velocity |
|---|---|---|
| Wedge Accelerator + Deflector | $2\lambda\sqrt{\frac{K_0}{K_1}} = \psi_0$ | $2\lambda\sqrt{\frac{K_0}{K_1}} = \psi_0$ |

Referring back to FIG. 5, an alternative embodiment 52 differs from embodiment 50 by tilting DC acceleration field 48 relative to the z-axis by angle $\lambda_0$ for aligning ion beam 41 parallel with starting equi-potential 46. Although the angles are shifted, however, the above described compensations survive.

Figure 6:
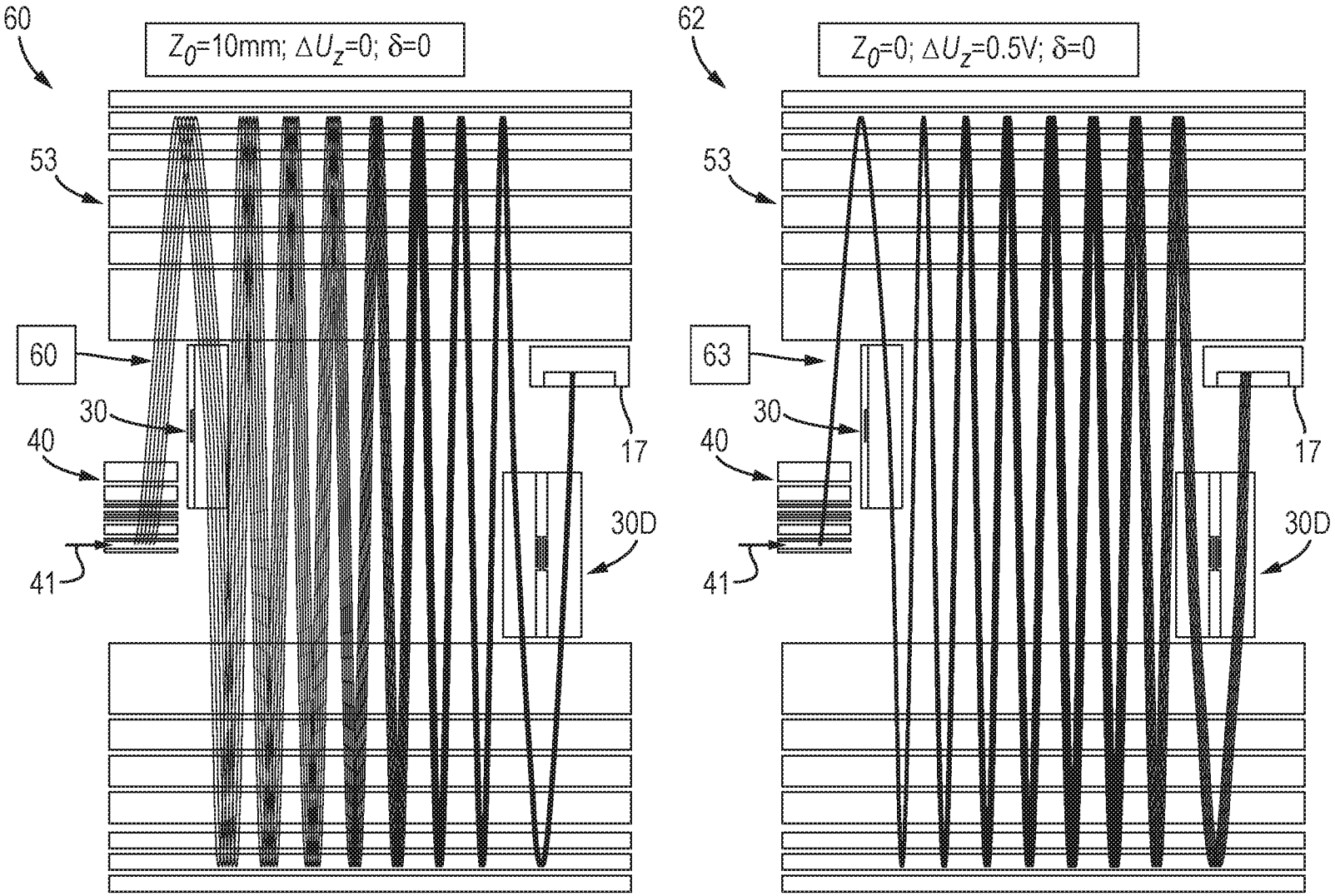
FIG. 6 shows numerical examples, illustrating ion packet spatial focusing within an MRTOF with the novel injection mechanism of FIG. 5, and presents a novel ion optical component of an embodiment of the present invention—a beam expander for bypassing detector rims, and demonstrates improved parameters of the exemplary compact MRTOF with resolution R>40,000.
Figure 6:
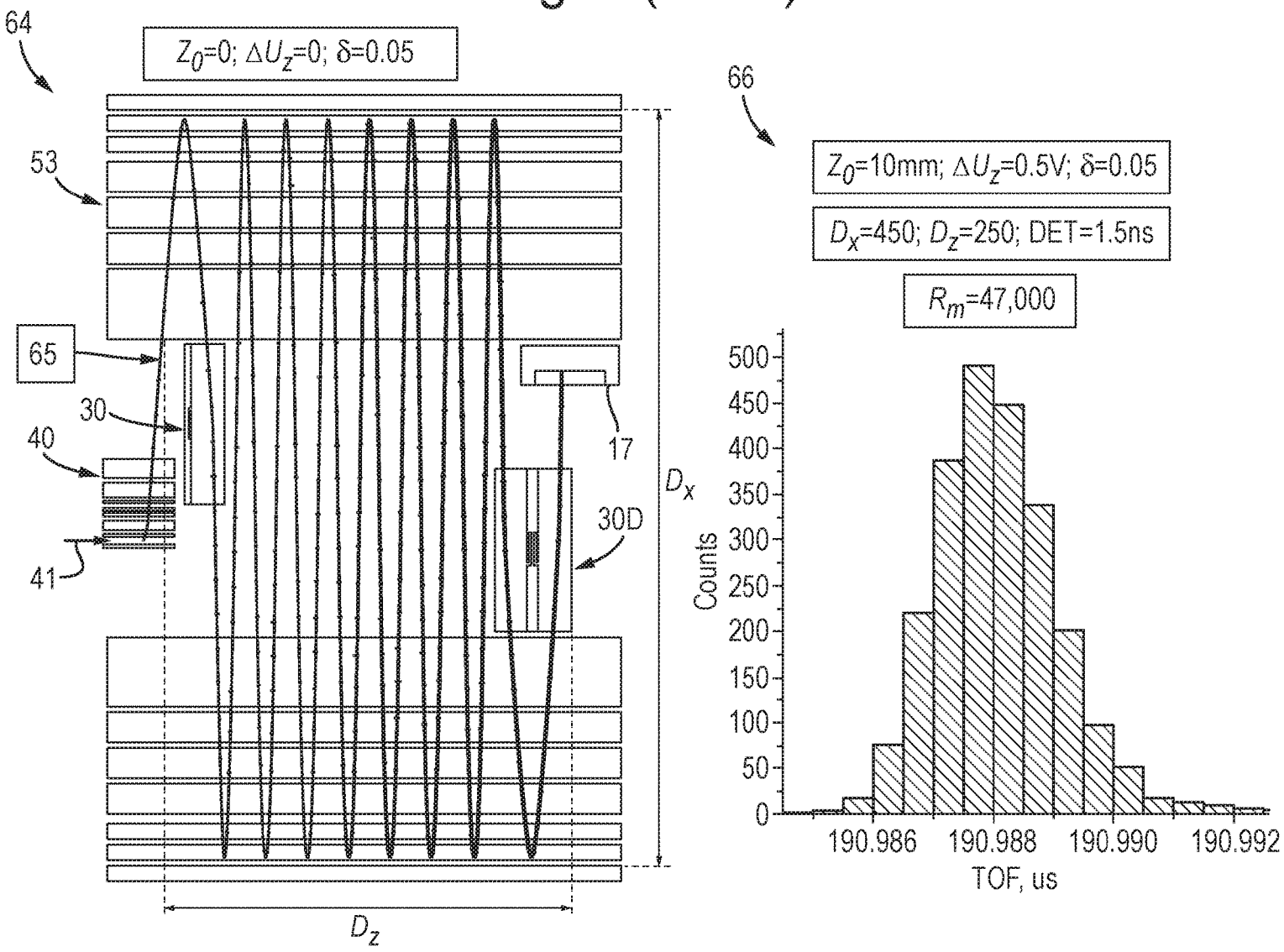

Referring to FIG. 6, the compensated mechanism 50 of ion injection into the MRTOF analyser has been verified in ion optical simulations 60, 62, 64 and 66. An exemplary MRTOF analyser comprises an ion mirrors 53 with cap-cap distance in the x-dimension of $D_X$=450 mm and useful width in the z-dimension of $D_Z$=250 mm, operating at acceleration potential in the x-dimension of $U_X$=8 kV. Examples of FIG. 6 employ compensated deflector 30 with the Matsuda plates of FIG. 3, amplifying wedge accelerator 40 of FIG. 4, dual deflector 30D with Matsuda plates, and TOF detector 17, assumed having DET=1.5 ns Gaussian signal spread. Similar to example 51, continuous ion beam of μ=1000 amu with ΔX=1 mm width and 2 deg full angular divergence enters wedge OA at $U_Z$=57V specific (per charge) energy and $\Delta U_Z$=0.5V energy spread.

Example 60 illustrates spatial focusing of ion rays 61 for ion packets having an initial width in the z-dimension of $Z_0$=10 mm, while not accounting angular spread of ion packets Δα=0 at $\Delta U_Z$=0 and not accounting relative energy spread of ion packets δ=ΔK/K=0 at ΔX=0. The chosen position of deflector 30 improves the ion packets bypassing of the deflector 30. The Matsuda plate voltage of the deflector 30 is electrically adjusted for geometrical focusing of ion packets onto the detector, which allows a denser folding of ion rays in MRTOF at $\alpha_2$=1.5 deg.

Example 62 illustrates angular divergence of ion rays 63 at $\Delta U_Z$=0.5V, while not accounting ion packets width $Z_0$=0 and energy spread δ=0. Dual compensated deflector 30D (another novel component for MRTOF) helps spreading ion rays in-front of the detector 17 for bypassing the detector rims (here 5 mm).

Example 64 illustrates the (predicted by Table 4) simultaneous compensation of chromatic angular spread α|δ=0 and of the first order time-front tilt γ=0 at δ=0.05, $\Delta U_Z$=0, and $Z_0$=0. Dark areas along the ion trajectories show lengths of ion packets due to the energy spread at equally spaced time intervals, and in particular time focusing after each reflection and at the detector.

Example 66 illustrates overall mass resolution $R_M$=47,000 achieved in a compact 450×250 mm analyzer while accounting all realistic spreads of ion beam and ion packets, so as DET=1.5 ns time spread. The embodiment satisfies a goal of R>40,000 for resolving major isobars for μ=m/z<500 in GC-MS instruments.

Apparently, the injection mechanism 50 has a built-in and not yet fully appreciated virtue—an ability to compensate for mechanical imperfections of the MRTOF analyser by electrical tuning of the instrument, including adjustment of ion beam energies $U_Z$, the pulse voltage on push plate 44, deflector 30 steering, or steering of continuous ion beam 41 to fit different equi-potentials 46.

Figure 7:
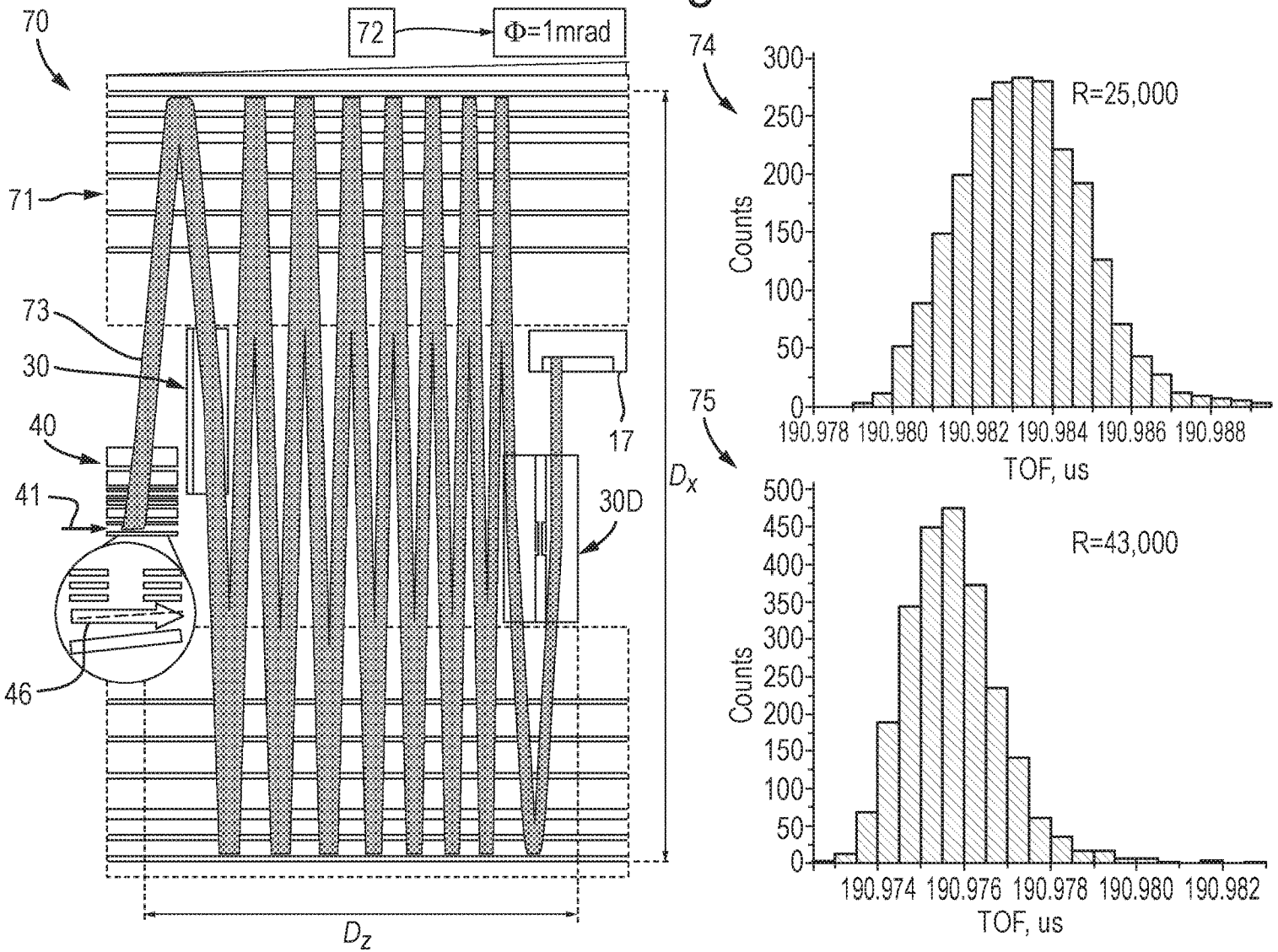
FIG. 7 shows a numerical example with unintentional ion mirror misalignment tilt of the ion mirror by 1 mrad, and illustrates how the novel injection mechanism of FIG. 5 helps compensating the misalignment with electrical adjustment of the instrument tuning.

Referring to FIG. 7, there is presented a simulation example 70, employing the MRTOF analyzer of FIG. 6 with $D_X$=450 mm, $D_Z$=250 mm, and $U_X$=8 kV. The example 70 is different from 60 by introducing a Φ=1 mrad tilt of the entire top mirror 71, representing a typical non intentional mechanical fault at manufacturing. If using the tuned settings of FIG. 6, resolution drops to 25,000 as shown in the graph 74. The resolution may be partially recovered to R=43,000 as shown in icon 75 by increasing the source bias and specific energy of continuous ion beam from $U_Z$=57V to $U_Z$=77V, and by retuning deflectors 30 and 30D. Example 70 shows ion rays after the compensation when accounting for all realistic ion beam and ion packet spreads, similar to FIG. 6. Thus, the proposed injection scheme 50 into a compact MRTOF allows compensating for moderate mechanical misalignments and recovering MRTOF resolution by electrical adjustments.

Figure 8:
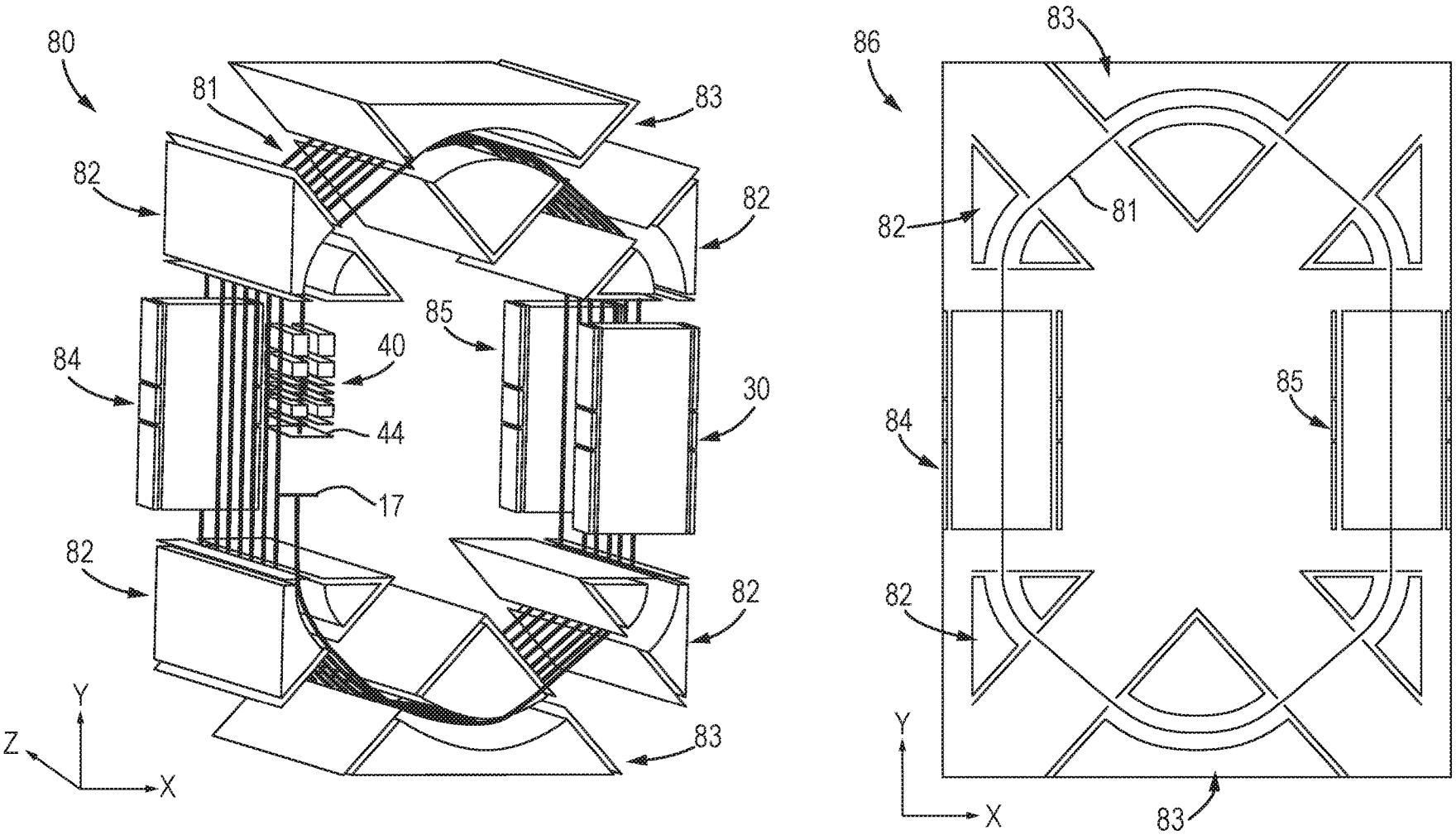
FIG. 8 shows a sector MTTOF of an embodiment of the present invention with two improvements, one employing the compensated ion injection mechanism similar to FIG. 7, and the second employing a novel method the far-end ion packet steering with deflectors having quadrupolar focusing and defocusing fields of Matsuda plates.
Figure 8:
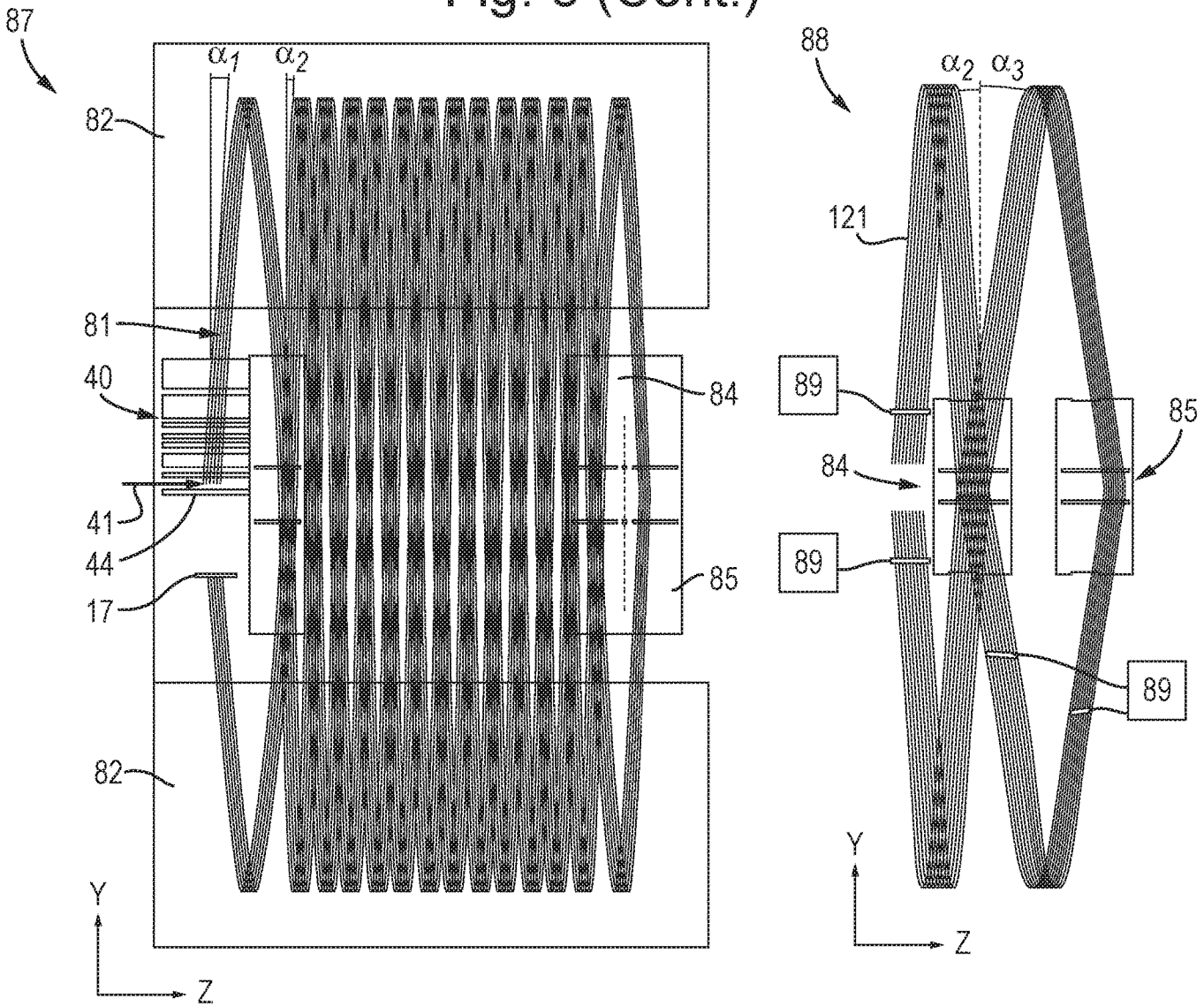

Referring to FIG. 8, an embodiment of a sector MTTOF analyser 80 of the present invention is shown, together with simulation examples 86, 87 and 88. The analyser comprises: sectors 82 and 83, separated by a drift space; an orthogonal accelerator 40 of FIG. 4, a compensated deflector 30 of FIG. 3; and a pair of compensated deflectors 84 and 85, similar to 30, however having different voltage settings of their Matsuda plates.

Electrodes of sectors 82 and 83 are extended in the Z-direction to form two-dimensional fields in the XY-plane, i.e. they do not have laminating fields of the prior art. Sectors 82 and 83 have different radii and are arranged for isochronous cycled trajectory 81 (well seen in the view 86) with at least second order time per energy focusing, as described in WO (RMS).

As shown in view 87, continuous ion beam 41 propagates along the Z-axis at elevated specific energy $U_Z$ (expected from 20 to 50V). A compensated ion injection mechanism into MTTOF 80 is arranged with a wedge accelerator 40 and compensated deflector 30, similar to injection mechanism 50, described in FIG. 5. Accelerator 40 with amplifying wedge accelerating field tilts the time front 89 of ion packets to compensate for the time front tilt of the downstream deflector 30, thus arranging dense trajectory folding at small inclination angles $\alpha_2$ while using relatively higher injection energies $U_Z$. Ion packets bypass the OA 40 at larger angle $\alpha_1$ and then advance in the drift Z-direction within MTTOF along the spiral trajectory 81 at reduced inclination angle $\alpha_2$. Thus, a combination of wedge accelerator and of compensated deflector is well suitable for sector MTTOF analysers.

Embodiment 80 presents yet another novel ion optical solution a compensated reversing of ion trajectories in the drift Z-direction. The idea of time front compensation after reversing is similar to that shown in arrangement 35 of FIG. 3. The reversing mechanism is arranged with a pair of focusing and defocusing deflectors 84 and 85, best seen and explained in simulation example 88, for clear view expanded in the Z-direction. Ion packets reach far Z-end of the sector analyzer at an inclination angle $\alpha_2$. Deflector 84 with Matsuda plates is set for increasing the inclination angle to $\alpha_3$ while focusing the packet Z-width within deflector 85. Deflector 85 is set to reverse ion trajectory with deflection for $-2\alpha_3$ angle and defocuses the packet from $Z_3$ to $Z_2$ by using Z-defocusing quadrupolar field of Matsuda plates in deflector 85. The focusing factor $Z_3/Z_2$ and deflection angles are arranged as $2Z_3*\alpha_3=Z_2(\alpha_3-\alpha_2)$ to mutually compensate for the time-front tilts, as illustrated with simulated dynamics of the time front 89. The proposed method of compensated reversing of ion trajectories is suitable for both MRTOF and MTTOF analyzers.

Figure 9:
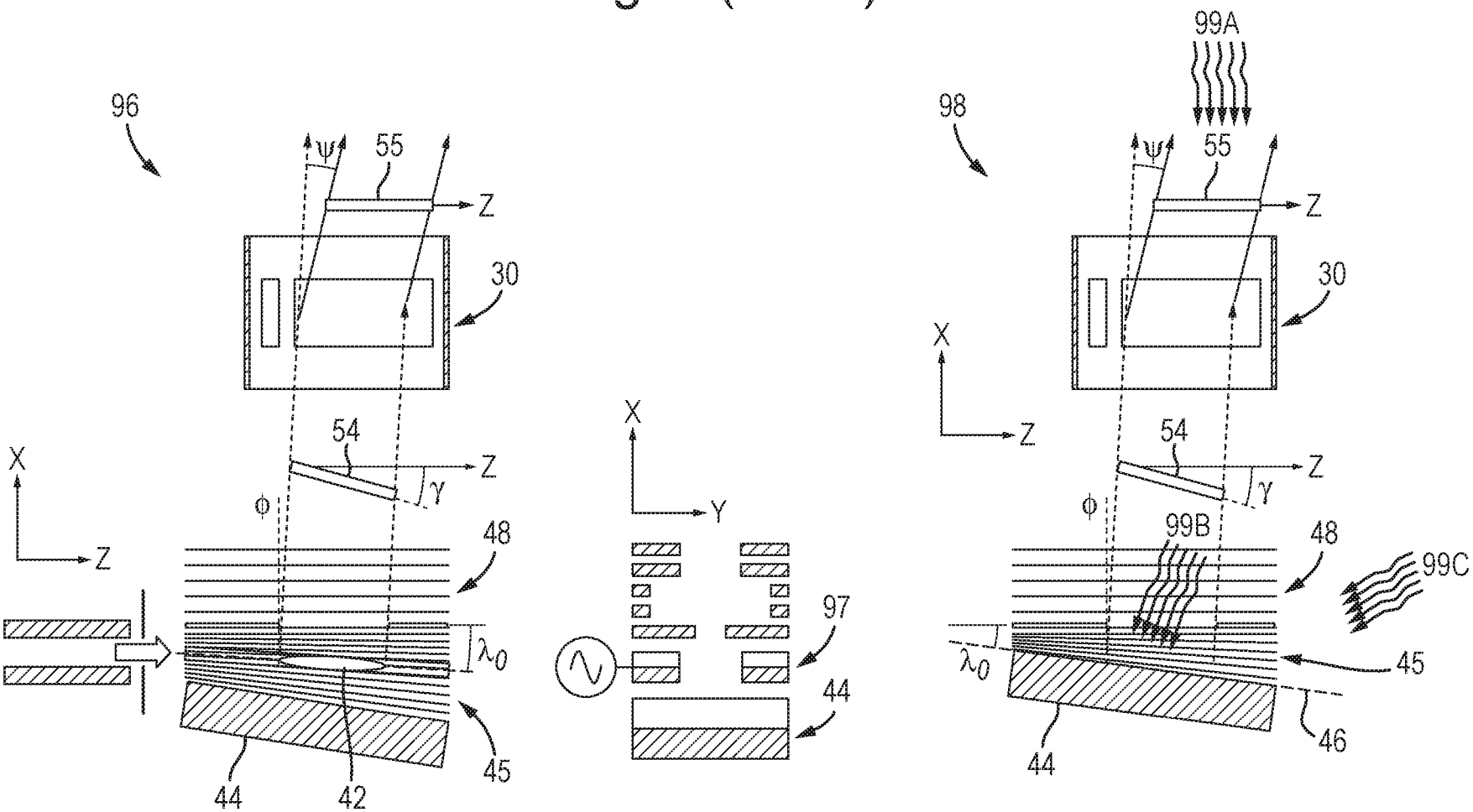
FIG. 9 shows alternative embodiments of pulsed ion sources and pulsed converters with novel amplifying wedge accelerating field.

Referring to FIG. 9, exemplary embodiments 90, 92, 94, 96 and 98 of the present invention illustrate a variety of alternative pulsed ion sources and pulsed converters with amplifying wedge field 45, arranged for electronically adjustable tilt of time-fronts 54. All examples comprise a wedge field region 45, arranged within the region of small ion energy, and a flat post-acceleration field 48 for amplification of the tilt angle $\gamma$ of time-front 54, preferably accompanied with notably smaller steering angle $\phi$ of ion trajectories. The time front tilt $\gamma$ may be arranged for compensation of the time front steering associated with the downstream trajectory steering for angle $\psi$, about matching the angle $\gamma$ for mutual compensation. Similar to previous drawings, ion starting equi-potentials are denoted as 46 and compensated deflectors are denoted by 30.

Deflectors 30 may be arranged anywhere downstream of the accelerator, which is illustrated by dashed ion rays between accelerator and deflector 30. However, to reduce the effect of ion packet angular divergence on compensation of time-front tilt, it is preferable to keep deflector 30 either immediately after the accelerator or after the first ion mirror reflection, or after the first electrostatic sector turn, or within the first full ion turn.

Example 90 presents an alternative spatial arrangement of the wedge accelerating field 45. An intermediate electrode 91 is tilted to produce the wedge at earlier stages of ion acceleration, though not immediately at ion starting point. Adjusting the potential of electrode 91 allows controlling the time front tilt angle $\gamma$ electronically.

Example 92 presents an arrangement with an intermediate printed circuit board 93, having multiple electrode segments (in the x-direction) that are interconnected via a resistive chain for generating a wedge field structure similar to that in embodiment 90. The PCB embodiment 92 may provide a yet wider range of $\gamma$ electronic tuning than 90.

Example 94 illustrates an application of the wedge accelerator to pulsed EI sources. Example 94 comprises an electron gun 95 and magnets B for controlling electron beam direction. Optionally, magnets may be tilted to align the electron beam with the tilted equipotential 46. Diverging electrodes within the EI source reduce the risk of electrode contamination by electron bombardment. Ions are produced by electron impact and are stored within the space charge field of the electron beam. Periodically electrical pulses are applied to tilted electrode 44. Example 94 provides compensated steering of ion rays past EI source, e.g. in order to bypass the accelerator and to adjust the inclination angle $\alpha$ of ion trajectories within an MRTOF or MTTOF analyser. The Matsuda plate potential in deflector 30 may be adjusted to control the ion packet spatial focusing.

Example 96 presents the application of the wedge accelerator to radio-frequency (RF) trap converters with radial ion ejection, known for their high (up to unity) duty cycle of pulsed conversion. The converter comprises side electrodes 97 at RF signal. The structure of electrodes 97 is better seen in the XY-plane. Ions are injected into the trap axially (in the x-direction) and are retained aligned with electrode 97 by the confining quadrupolar RF field of electrodes 97. In one (through) mode, the beam may propagate along equipotential 46 at small energy. In another (trapping) mode ions may be slowly dampened by gas at moderate mid-vacuum pressure (e.g. around 1 mTorr within several ms time). Ion packets are periodically ejected by energizing push plate 44. Tilting of push plate 44 controls the time-front tilt $\gamma$, which may be produced for compensating the downstream steering of time fronts by deflector 30. Example 96 provides compensated steering of ion rays past radial traps, e.g. in order to bypass the trap and to adjust the inclination angle $\alpha$ of ion trajectories within MRTOF or MTTOF analysers. The Matsuda plate potential in deflector 30 may be adjusted to control the ion packet spatial focusing. Note that to compensate T|ZZ aberrations at focusing in deflector 30 of substantially elongated ion packets, an additional compensating field curvature may be generated within accelerating field 45, either by curving electrode 97, or by curving of other trap electrodes, or by auxiliary fringing field, penetrating through or between trap electrodes.

Example 98 presents the application of the wedge accelerator to surface ionization methods, such as MALDI, SIMS, FAB, or particle bombardment, defined by the nature of primary beam 99—either photons, or pulsed packets of primary ions, or neutral particles or glow discharge or heavy particles or charged droplets. Electrode 44 may be energized static or pulsed, depending on the overall arrangement of prior art ionization methods. It is assumed that the exposed surface is relatively wide, either for imaging purposes or for improved sensitivity, so that ion packet width does affect the time-of-flight resolution, if ion packets are steered without compensation. Arranging wedge accelerator field 45, for example by tilting the target 44, is used here for compensating the time front tilt steering or for the spatial focusing of ion packets, or as a part of the surface imaging ion optics. Benefits of example 98 may be immediately seen by experts such as: (a) steering of ion packets allows the ion source bypassing and denser folding of ion trajectory in MPTOF analysers; (b) focusing by deflector 30 improves sensitivity; (c) unintentional tilt of the target 44 or some uneven topology of the sample on the target may be compensated electronically; (d) ion steering off the source axis allows an orthogonal arrangement of the impinging primary beam 99A; (e) compensated edge and curvature of accelerating field may be used for improving stigmatic properties of the overall imaging ion optics. Some further benefits are likely to be found, since the scheme allows fine and electronically adjustable control over the spatial focusing and the time-of-flight aberrations of the surface ionizing sources.

Annotations

Coordinates and Times:

x,y,z—Cartesian coordinates;

X, Y, Z—directions, denoted as: X for time-of-flight, Z for drift, Y for transverse;

$Z_0$— initial width of ion packets in the drift direction;

$\Delta Z$—full width of ion packet on the detector;

$D_X$ and $D_Z$—used height (e.g. cap-cap) and usable width of ion mirrors

L—overall flight path

N—number of ion reflections in mirror MRTOF or ion turns in sector MTTOF u—x-component of ion velocity;

w—z-component of ion velocity;

T—ion flight time through TOF MS from accelerator to the detector;

ΔT—time spread of ion packet at the detector;

Potentials and Fields:

U—potentials or specific energy per charge;

$U_Z$ and $\Delta U_Z$—specific energy of continuous ion beam and its spread;

$U_X$—acceleration potential for ion packets in TOF direction;

K and ΔK—ion energy in ion packets and its spread;

δ=ΔK/K—relative energy spread of ion packets;

E—x-component of accelerating field in the OA or in ion mirror around "turning" point;

μ=m/z—ions specific mass or mass-to-charge ratio;

Angles:

α—inclination angle of ion trajectory relative to X-axis;

Δα—angular divergence of ion packets;

γ—tilt angle of time front in ion packets relative to Z-axis

λ—tilt angle of "starting" equipotential to axis Z, where ions either start accelerating or are reflected within wedge fields of ion mirror θ—tilt angle of the entire ion mirror (usually, unintentional);

φ—steering angle of ion trajectories or rays in various devices;

ψ—steering angle in deflectors

ε—spread in steering angle in conventional deflectors;

Aberration Coefficients

T|Z, T|ZZ, T|δ, T|δδ, etc;

indexes are defined within the text

Although the present invention has been describing with reference to preferred embodiments, it will be apparent to those skilled in the art that various modifications in form and detail may be made without departing from the scope of the present invention as set forth in the accompanying claims.

The invention claimed is:

1. A mass spectrometer having:

a pulsed ion accelerator; wherein the pulsed ion accelerator is configured to receive ions travelling in a first direction between electrodes that converge in the first direction, and wherein the pulsed ion accelerator comprises:

at least one voltage supply arranged and configured to apply a pulsed voltage to said electrodes for generating a wedge shaped electric field that pulses ions out of the ion accelerator, wherein the ions have a time front arranged in a first plane at the time the pulsed voltage is initiated, and wherein the wedge-shaped electric field causes the time front of the ions to be tilted at an angle to the first plane; and an ion acceleration region downstream of the wedge-shaped electric field region for amplifying the time front tilt introduced by the wedge-shaped electric field, wherein the pulsed ion accelerator comprises a plurality of ion acceleration region electrodes configured to apply an electric field in the ion acceleration region having parallel equipotential field lines for accelerating the ions; and an ion deflector located downstream of the pulsed ion accelerator and configured to deflect the average ion trajectory of the ions, thereby tilting the angle of the time front of the ions received by the ion deflector, wherein the wedge-shaped electric field region of the pulsed ion accelerator is configured to tilt the time front of the ions passing therethrough so as to at least partially counteract the tilting of the time front by the ion deflector; and an ion mirror, wherein the ion deflector is arranged to receive ions after they have been reflected in the ion mirror.

2. The mass spectrometer of claim 1, wherein the pulsed ion accelerator is an orthogonal accelerator.

3. The mass spectrometer of claim 1, wherein said electrodes are arranged and configured for generating said wedge-shaped electric field region therebetween such that equipotential field lines in the wedge-shaped electric field region are angled to each other so as to form the wedge-shape.

4. The mass spectrometer of claim 1, wherein said electrodes comprise one or more first electrode arranged in a first plane and one or more second electrode arranged in a second plane that is angled to the first plane so as to define the wedge-shaped electric field region between the one or more first electrode and one or more second electrode.

5. The mass spectrometer of claim 1, wherein said electrodes comprise one or more first electrode arranged in a first plane and a plurality of second electrodes arranged in a second plane, wherein the ion accelerator is configured to apply different voltages to different ones of the second electrodes so as to define the wedge-shaped electric field region between the one or more first electrode and the second electrodes.

6. The mass spectrometer of claim 1, wherein the electrodes for generating said wedge-shaped electric field region are arranged so that equipotential field lines of the wedge-shaped electric field extend substantially in the first direction and the ion accelerator is configured to pulse the ions through the wedge-shaped electric field substantially transverse to the equipotential field lines.

7. The mass spectrometer of claim 1, wherein the ion accelerator is arranged and configured to receive ions travelling in the first direction along a first axis that is substantially parallel to equipotential field lines of the wedge-shaped electric field.

8. The mass spectrometer of claim 1, comprising two ion mirrors, wherein the ion deflector is arranged to receive ions after they have been reflected in a first of the two ion mirrors for the first time but before being reflected in a second of the two ion mirrors for a first time.

9. The mass spectrometer of claim 8, wherein said plurality of ion acceleration region electrodes are a plurality of parallel electrodes.

10. The mass spectrometer of claim 8, wherein the deflector is configured to tilt the angle of the time front of the ions received by the ion deflector such that the time front of the ions is parallel to the first plane immediately after leaving the deflector.

11. The mass spectrometer of claim 1, wherein the ion deflector is configured to generate a quadrupolar field for controlling the spatial focusing of the ions.

12. A mass spectrometer comprising:

a multi-pass time-of-flight mass analyser or electrostatic ion trap having the pulsed ion accelerator of claim 1, and electrodes arranged and configured so as to provide an ion drift region that is elongated in a drift direction (z-dimension) and to reflect or turn ions multiple times in an oscillating dimension (x-dimension) that is orthogonal to the drift direction.

13. The spectrometer of claim 12, wherein:

(i) the multi-pass time-of-flight mass analyser is a multi-reflecting time of flight mass analyser having two ion mirrors that are elongated in the drift direction (z-dimension) and configured to reflect ions multiple times in the oscillation dimension (x-dimension), wherein the pulsed ion accelerator is arranged to receive ions and accelerate them into one of the ion mirrors; or (ii) the multi-pass time-of-flight mass analyser is a multi-turn time of flight mass analyser having at least two electric sectors configured to turn ions multiple times in the oscillation dimension (x-dimension), wherein the pulsed ion accelerator is arranged to receive ions and accelerate them into one of the sectors.

14. The spectrometer of claim 12, comprising an ion deflector located downstream of said pulsed ion accelerator, and that is configured to back-steer the average ion trajectory of the ions, in the drift direction, thereby tilting the angle of the time front of the ions received by the ion deflector.

15. The spectrometer of claim 14, wherein the ion deflector is configured to generate a quadrupolar field for controlling the spatial focusing of the ions in the drift direction.

16. A method of mass spectrometry comprising:

providing the mass spectrometer as claimed in claim 1;

applying the pulsed voltage to said at least one of said electrodes for pulsing said wedge-shaped electric field region so as to pulse ions out of the ion accelerator, wherein the ions have a time front arranged in the first plane at the time the pulsed voltage is initiated, and wherein the ions pass through the wedge-shaped electric field region so as to cause the time front of the ions to be tilted at the angle to the first plane.

17. The mass spectrometer of claim 1, wherein the deflector comprises two plates arranged in planes substantially orthogonal to the ion path between them.

18. The mass spectrometer of claim 1, wherein the mass spectrometer is gridless.

19. A mass spectrometer having:

a pulsed ion accelerator, said ion accelerator comprising:

a plurality of electrodes and at least one voltage supply arranged and configured to generate a wedge-shaped electric field region within the ion accelerator; wherein the plurality of electrodes comprises one or more first electrode arranged in a first plane and a plurality of second electrodes arranged in a second plane, wherein the ion accelerator is configured to apply different voltages to different ones of the second electrodes so as to define the wedge-shaped electric field region between the one or more first electrode and the second electrodes; and an ion acceleration region downstream of the wedge-shaped electric field region for amplifying the time front tilt introduced by the wedge-shaped electric field, wherein the pulsed ion accelerator comprises a plurality of ion acceleration region electrodes configured to apply an electric field in the ion acceleration region having parallel equipotential field lines for accelerating the ions;

wherein the ion accelerator is configured to apply a pulsed voltage to at least one electrode of the ion accelerator for pulsing ions out of the ion accelerator, wherein the ions have a time front arranged in an initial plane at the time the pulsed voltage is initiated, and wherein the ion accelerator is configured such that the pulsed ions pass through the wedge-shaped electric field region before leaving the ion accelerator so as to cause the time front of the ions to be tilted at an angle to the initial plane;

an ion deflector located downstream of the ion accelerator and configured to deflect the average ion trajectory of the ions, thereby tilting the angle of the time front of the ions received by the ion deflector; wherein the wedge-shaped electric field region of the ion accelerator is configured to tilt the time front of the ions passing therethrough so as to at least partially counteract the tilting of the time front by the ion deflector; and an ion mirror, wherein the ion deflector is arranged to receive ions after they have been reflected in the ion mirror.

20. The mass spectrometer of claim 19, wherein the first plane is parallel to the second plane.

* * * * *